US006752159B1

(12) United States Patent
Kavadeles et al.

(10) Patent No.: US 6,752,159 B1
(45) Date of Patent: Jun. 22, 2004

(54) DYNAMIC OIL FLUSHER CLEANING SYSTEM

(75) Inventors: Bill Kavadeles, Carlsbad, CA (US); John A. Rome, Huntington, CA (US)

(73) Assignee: Motorvac Technologies, Inc., Santa Ana, CA (US)

( * ) Notice: Subject to any disclaimer, the term of this patent is extended or adjusted under 35 U.S.C. 154(b) by 112 days.

(21) Appl. No.: 10/055,544

(22) Filed: Jan. 22, 2002

Related U.S. Application Data

(60) Provisional application No. 60/313,838, filed on Aug. 21, 2001.

(51) Int. Cl.[7] ..... B08B 5/02

(52) U.S. Cl. ..... 134/22.12; 134/22.18; 134/95.2; 134/102.2; 134/103.1; 134/169 A; 134/169 R

(58) Field of Search ..... 134/56 R, 94.1, 134/95.1, 95.2, 99.2, 100.1, 102.2, 103.1, 166 R, 169 R, 169 A

(56) References Cited

U.S. PATENT DOCUMENTS

| | | | | |
|---|---|---|---|---|
| 2,912,990 A | * | 11/1959 | Wilson | 134/103.2 |
| 4,059,123 A | * | 11/1977 | Bartos et al. | 134/102.2 |
| 4,412,551 A | * | 11/1983 | Peters et al. | 134/104.4 |
| 4,520,773 A | * | 6/1985 | Koslow | 123/198 A |
| 4,597,416 A | * | 7/1986 | Scales | 137/899.4 |
| 4,951,784 A | | 8/1990 | Bedi | |
| 4,989,561 A | * | 2/1991 | Hein et al. | 123/198 A |
| 5,062,398 A | | 11/1991 | Bedi et al. | |
| 5,063,896 A | | 11/1991 | Hyatt et al. | |
| 5,090,376 A | | 2/1992 | Bedi | |
| 5,094,201 A | | 3/1992 | Bedi | |
| 5,154,775 A | | 10/1992 | Bedi | |
| 5,168,844 A | | 12/1992 | Waelput | |
| 5,232,513 A | * | 8/1993 | Suratt et al. | 134/21 |
| 5,249,608 A | | 10/1993 | Hua | |
| 5,271,361 A | | 12/1993 | Flynn | |
| 5,287,834 A | | 2/1994 | Flynn | |
| 5,289,837 A | * | 3/1994 | Betancourt | 134/57 R |
| 5,383,481 A | | 1/1995 | Waelput et al. | |
| 5,452,696 A | | 9/1995 | Flynn | |
| 5,460,656 A | | 10/1995 | Waelput et al. | |

(List continued on next page.)

FOREIGN PATENT DOCUMENTS

| | | |
|---|---|---|
| EP | 0279113 | 8/1998 |

*Primary Examiner*—Frankie L. Stinson
(74) *Attorney, Agent, or Firm*—Farjami & Farjami LLP

(57) ABSTRACT

An exemplary cleaning apparatus for cleaning a system having a first fluid is provided, wherein the apparatus comprises a second fluid entering the system and cycling in the system with the first fluid for a predetermined period of time. The cleaning apparatus also comprises an air compressor and an air storage tank. The air compressor is capable of compressing air into air storage tank, and air storage tank is capable of delivering air to the system for purging the first and second fluids from the system after the predetermined period of time has expired. The cleaning apparatus further comprises an air regulator capable of regulating pressure of the air delivered to the system.

13 Claims, 13 Drawing Sheets

U.S. PATENT DOCUMENTS 5,462,679 A 10/1995 Verdegan et al.
5,467,746 A 11/1995 Waelput et al.
5,472,064 A 12/1995 Viken
5,474,098 A 12/1995 Grigorian et al.
5,562,181 A 10/1996 Elkin et al.
5,685,396 A 11/1997 Elkin et al.
5,746,259 A * 5/1998 Noble, III ..... 141/92
5,791,310 A 8/1998 Grigorian et al.
5,813,382 A 9/1998 Grigorian et al.
5,833,765 A 11/1998 Flynn et al.
5,845,225 A 12/1998 Mosher
5,921,213 A 7/1999 Grigorian et al.
5,964,256 A 10/1999 Bedi et al.
6,033,578 A 3/2000 Loewen
6,041,798 A 3/2000 Grigorian et al.
6,089,205 A 7/2000 Grigorian et al.
6,123,174 A 9/2000 Elkin et al.
6,142,161 A 11/2000 Abbruzze
6,213,133 B1 4/2001 Reicks
6,213,172 B1 4/2001 Dickson
6,263,889 B1 7/2001 Flynn et al.
6,273,031 B1 * 8/2001 Verdegan et al. ..... 123/1 A
6,298,947 B1 * 10/2001 Flynn ..... 184/1.5

* cited by examiner

DYNAMIC OIL FLUSHER CLEANING SYSTEM

RELATED APPLICATIONS

The present application claims the benefit of U.S. provisional application serial No 60/313,838, filed Aug. 21, 2001, which is hereby fully incorporated by reference in the present application.

BACKGROUND OF THE INVENTION

1. Field of the Invention

The present invention relates generally to servicing oil system. More particularly, the present invention relates to method and apparatus for cleaning engine oil systems.

2. Related Art

It is well known that an internal combustion engine accumulates oil sludge and debris in the oil passageways of the vehicle engine through normal use. The accumulated oil sludge and debris can form hardened oil and hydrocarbon deposits on the walls of the oil passageways in the vehicle engine. These hardened oil and hydrocarbon deposits restrict oil flow through the engine and thus shorten the vehicle engine's life. Therefore, it is desirable to periodically clean the engine's oil passageways to maintain proper oil flow throughout the engine and thereby prevent unnecessary shortening of the vehicle engine's life.

Typically, contaminated oil is removed from a vehicle engine by draining the contaminated oil out of the vehicle engine and replacing it with fresh oil during regularly scheduled vehicle engine maintenance. Although contaminated oil can be drained out of the vehicle engine, oil sludge and debris that can clog the vehicle engine's oil passageways are not so easily removed. The removal of the oil sludge and debris typically requires a cleaning solution to circulate through the vehicle engine's oil passageways to dissolve the oil and sludge debris.

One method for removing oil sludge and debris from the vehicle engine utilized by conventional engine oil system cleaning machines involves circulating a cleaning solution through the vehicle engine oil lubrication system while the vehicle engine is running. However, such conventional engine oil system cleaning machines typically require an operator to use valuable service time to determine, measure, and dispense the correct amount of cleaning solution required for a particular vehicle engine. Also, the conventional engine oil system cleaning machines require the operator to continuously monitor the vehicle engine oil pressure to prevent a drop in engine oil pressure from damaging the vehicle engine.

After the cleaning cycle of a conventional engine oil cleaning machine is over, the contaminated oil and sludge are typically removed from the vehicle engine by allowing the contaminated oil and sludge to drain out of the vehicle engine drain hole. However, after the contaminated oil and sludge has drain out of the vehicle engine drain hole, residual sludge remains in the vehicle engine oil system.

One conventional method of removing residual sludge from the vehicle engine utilizes pressurized air, which can be injected into the vehicle engine oil system by an operator. However, the pressure of the air that is injected into the vehicle engine oil system must be carefully controlled to avoid damaging the vehicle engine oil system. Further, the pressurized air can also damage the vehicle engine oil system if the pressurized air is injected into the vehicle engine oil system for an excessive amount of time.

Additionally, a service shop air source must be available to provide the pressurized air. However, utilizing pressurized air from the service shop air source makes the conventional engine oil cleaning system non-portable.

Thus, there is an intense need for cost-effective and efficient vehicle engine oil cleaning systems and cleaning methods that can overcome the disadvantages of the conventional cleaning systems and methods, and that can safely purge the vehicle engine oil system of residual oil sludge.

SUMMARY OF THE INVENTION

The present invention is directed to apparatus and method for servicing engine oil systems. More specifically, the invention provides a cleaning system for cleaning an engine oil system and safely purging the engine oil system of residual oil sludge.

An exemplary cleaning apparatus for cleaning a system having a first fluid is provided, wherein the apparatus comprises a second fluid entering the system and cycling in the system with the first fluid for a predetermined period of time. The cleaning apparatus also comprises an air compressor and an air storage tank. The air compressor is capable of compressing air into air storage tank, and air storage tank is capable of delivering air to the system for purging the first and second fluids from the system after the predetermined period of time has expired. The cleaning apparatus further comprises an air regulator capable of regulating pressure of the air delivered to the system.

The cleaning apparatus may also comprise an air pressure shutoff switch capable of shutting off the air compressor when the air pressure reaches a predetermined level. The cleaning apparatus may further comprise an air pressure gauge coupled to the air compressor, the air pressure gauge capable of measuring the air pressure. The cleaning apparatus may further comprise a timed air release control controlling an air release solenoid, the air release solenoid capable of receiving air from the air storage tank and delivering the air to the system.

These and other aspects of the present invention will become apparent with further reference to the drawings and specification, which follow. It is intended that all such additional systems, features and advantages be included within this description, be within the scope of the present invention, and be protected by the accompanying claims.

BRIEF DESCRIPTION OF THE DRAWINGS

The features and advantages of the present invention will become more readily apparent to those ordinarily skilled in the art after reviewing the following detailed description and accompanying drawings, wherein.

DETAILED DESCRIPTION OF THE INVENTION

The present invention is directed to system and method for servicing engine oil systems. The present invention may be described herein in terms of functional block components and various processing steps. It should be appreciated that such functional blocks may be realized by any number of hardware or software components configured to perform the specified functions. It should be further appreciated that the particular implementations shown and described herein are merely exemplary and are not intended to limit the scope of the present invention in any way.

Figure 1:
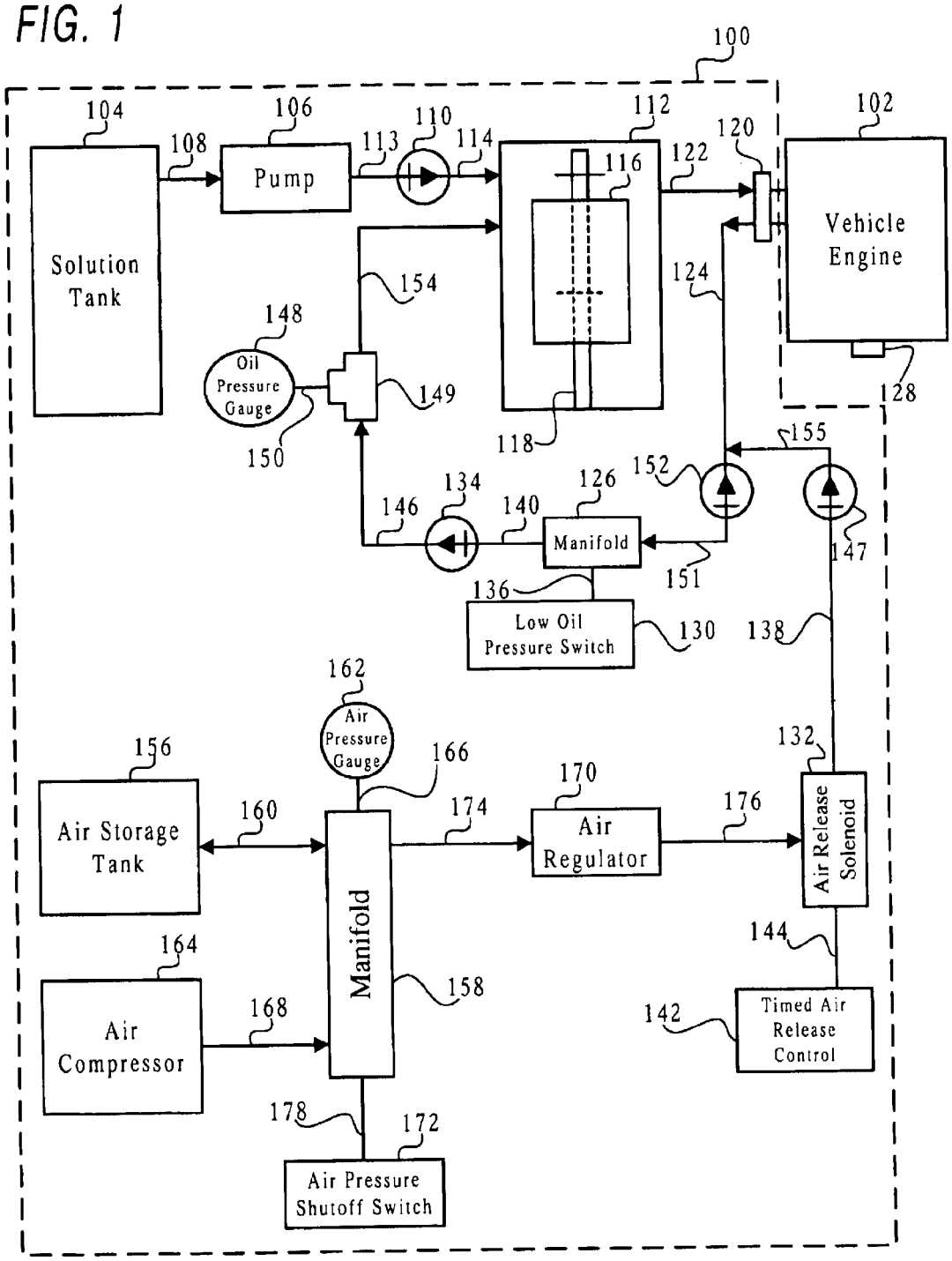
FIG. 1 illustrates an exemplary diagram of a dynamic oil flusher cleaning system according to one embodiment of the present invention.

FIG. 1 shows a detailed diagram of dynamic oil flusher cleaning system 100 according to one embodiment of the present invention. As shown in FIG. 1, dynamic oil flusher cleaning system 100 can be connected to vehicle engine 102 for servicing the oil lubrication system of vehicle engine 102. Dynamic oil flusher cleaning system 100 uses a dynamic cleaning cycle to clean the oil passageways of a diesel or gasoline vehicle engine by circulating cleaning detergent solution through the vehicle engine oil lubrication system while the vehicle engine is running. Dynamic oil flusher cleaning system 100 also uses an air cleaning cycle to back flush and clean the vehicle engine oil lubrication system by injecting a stream of pressure-regulated air into the vehicle engine oil lubrication system. In other embodiments, dynamic oil flusher cleaning system 100 can be reconfigured to clean a vehicle's transmission, hydraulic, and coolant fluid systems.

Dynamic oil flusher cleaning system 100 includes solution tank 104 and pump 106. Solution tank 104 may contain a cleaning detergent solution for cleaning a vehicle engine oil lubrication system. The cleaning detergent solution can be pumped out of solution tank 104 by pump 106, which is coupled to solution tank 104 via conduit 108. In one embodiment, solution tank 104 may also contain fresh oil for filling the vehicle engine oil lubrication system. Pump 106 can be a 12.0 vdc 1.0 gpm (gallons per minute) diaphragm pump. In one embodiment, pump 106 can be a 12.0 vdc pump with a diaphragm comprised of "Viton" material. Solution tank 104 may include a fill port (not shown in FIG. 1) for adding cleaning detergent solution. In one embodiment, solution tank 104 may be made of a clear material to allow the fluid solvent solution level in solution tank 104 to be visually determined.

Dynamic oil flusher cleaning system 100 also includes valve 110 for preventing cleaning detergent solution from flowing back to pump 106 via conduit 113, which couples pump 106 to valve 110. In other words, valve 110 allows cleaning detergent solution to flow from pump 106 into conduit 114 via conduit 113, but prevents cleaning detergent solution from flowing in the reverse direction (i.e. from conduit 114 to pump 106 via conduit 113). In one embodiment, valve 110 can be a 0.5 lb one-way check valve. Dynamic oil flusher cleaning system 100 further includes solution housing 112, which is coupled to valve 110 via conduit 114. In one embodiment, solution housing 112 can comprise clear plastic or other clear material through which cleaning detergent solution may be visually detected. Solution housing 112 includes filter 116 for filtering contaminated cleaning detergent solution that flows through solution housing 112 when dynamic oil flusher cleaning system 100 is dynamically cleaning the oil lubrication system of vehicle engine 102. Filter 116 can comprise cellulose, polyester, paper or cotton. In one embodiment, filter 116 can be a single-use disposable 5.0 micron filter for cleaning either diesel or gasoline vehicle engine oil lubrication systems. In another embodiment, filter 116 can be a spin-on 10.0 micron filter element with a 1.0 quart capacity. It should be noted that in some embodiments (not shown), solution housing 112 may not include a filter, but rather function as a fluid container where a filter is positioned outside such fluid container, so that the fluid is filtered prior to entering such fluid container or after leaving such fluid container.

Solution housing 112 further includes pump shutoff switch 118 for automatically shutting off pump 106 after pump 106 has dispensed a pre-determined amount of cleaning detergent solution into solution housing 112. In one embodiment, switching device 118 can automatically shut off pump 106 when pump 106 has dispensed 16.0 ounces of cleaning detergent solution for cleaning a gasoline vehicle engine oil lubrication system. In another embodiment, switching device 118 can automatically shut off pump 106 when pump 106 has dispensed 32.0 ounces of cleaning detergent solution for cleaning a diesel vehicle engine oil lubrication system. Pump shutoff switch 118 can be a two-position reed sensing switch. In one embodiment, pump shutoff switch 118 can be a two-position optical level sensing switch. In other embodiments, pump shutoff switch 118 can be a two-position proximity, mechanical float, or magnetic sensing switch. The operation of pump shutoff switch 118 will be discussed in greater detail in relation to FIG. 4. Solution housing 112 further includes a drain petcock (not shown in FIG. 1) for draining waste oil and cleaning detergent mixture out of solution housing 112 at completion of servicing of a vehicle engine oil lubrication system. Solution housing 112 may also include an atmospheric vent (not shown in FIG. 1) for releasing air pressure in solution housing 112.

Solution housing 112 is coupled to oil filter adapter 120 via output hose 122. Output hose 122 is connected to oil filter adapter 120 via a connector (not shown in FIG. 1), which is attached to an end of output hose 122. A check valve in the connector can close to prevent fluid from escaping from output hose 122 when the connector is disconnected from oil filter adapter 120. Likewise, the check valve in the connector opens to allow fluid to flow through output hose 122 when the connector is connected to oil filter adapter 120. In one embodiment, the connector may be a quick disconnect fitting having a spring-loaded check valve.

Oil filter adapter 120 couples output hose 122 and return hose 124 of dynamic oil flusher cleaning system 100 to the oil lubrication system of vehicle engine 102. Return hose 124 is connected to oil filter adapter 120 via a connector (not shown in FIG. 1), which is attached to an end of return hose 124. The above connector attached to return hose 124 is similar to the connector attached to output hose 122 described above. The oil pump in vehicle engine 102 is utilized to pump cleaning detergent solution from solution housing 112 into vehicle engine 102 via output hose 122 when vehicle engine 102 is turned on. The vehicle engine oil pump is also utilized to circulate a mixture of oil and cleaning detergent solution through dynamic oil flusher cleaning system 100 and the oil lubrication system of vehicle engine 102 during the operation of the dynamic cleaning cycle. In one embodiment, output hose 122 and return hose 124 can be clear hoses in which oil flow may be visually detected. In one embodiment, oil filter adapter 120 can use internal thread inserts and outer sealing adapter plates with various size o-rings to provide proper coupling to a vehicle engine. Oil filter adapter 120 can be connected to vehicle engine 102 by installing oil filter adapter 120 in place of vehicle engine 102 oil filter (not shown in FIG. 1). Vehicle engine 102 includes oil drain plug 128, which can be removed to drain oil from vehicle engine 102.

Dynamic oil flusher cleaning system 100 further includes valve 152, which couples return hose 124 to conduit 151. Valve 152 allows cleaning detergent solution to flow from return hose 124 through conduit 151 during a dynamic cleaning cycle (i.e. when cleaning detergent solution is circulating through the oil lubrication system of vehicle engine 102). During an air cleaning cycle (i.e. when pressure-regulated air is used to back flush and clean the oil lubrication system of vehicle engine 102), valve 152 prevents pressure-regulated air from flowing into conduit 151. In one embodiment, valve 152 can be a 12.0 vdc solenoid operated control valve. In one embodiment, valve 152 may not be used.

Dynamic oil flusher cleaning system 100 further includes manifold 126, low oil pressure switch 130, and valve 134. Manifold 126 is connected to valve 152 via conduit 151, and can be a 3-port manifold. Low oil pressure switch 130, which is coupled to manifold 126 via conduit 136, can provide a warning when the oil pressure in manifold 126 falls below a specified level. For example, low oil pressure switch 130 can sound an alarm on a control panel (not shown in FIG. 1) when oil pressure in manifold 126 falls below 5.0 psi (pounds per square inch). In one embodiment, low oil pressure switch 130 can be a 0.0 psig to 5.0 psig (pounds per square inch gauge) switch. In another embodiment, low oil pressure switch 130 can be an oil-sending unit. Similar to valve 110 discussed above, valve 134 can prevent cleaning detergent solution from flowing back to manifold 126 via conduit 140, which couples manifold 126 to valve 134. In other words, valve 134 allows cleaning detergent solution to flow from manifold 126 into conduit. 146 via conduit 140, but prevents cleaning detergent solution from flowing in the reverse direction (i.e. from conduit 146 to manifold 126 via conduit 140). In one embodiment, valve 134 can be a 3.0 lb one-way check valve. Dynamic oil flusher cleaning system 100 further includes oil pressure gauge 148 for measuring the oil pressure of vehicle engine 102. In one embodiment, oil pressure gauge 148 can have a range of 0.0 psig to 100.0 psig. Tee fitting 149 is coupled to oil pressure gauge 148 via conduit 150, and is further coupled to solution housing 112 via conduit 154.

Dynamic oil flusher cleaning system 100 further includes air storage tank 156 for storing pressurized air for flushing and purging of oil lubrication system of vehicle engine 102. Air storage tank 156 can be an ASME (American Society of Mechanical Engineers) rated air storage tank with a storage capacity in a range of 0.5 to 1.5 cubic feet. For example, air storage tank 156 has a sufficient capacity for one air cleaning cycle. In one embodiment, air storage tank 156 may have a sufficient capacity for approximately two or more air cleaning cycles. Dynamic oil flusher cleaning system 100 also includes manifold 158, which can be a 5-port air manifold that is coupled to air storage tank 156 via conduit 160.

Dynamic oil flusher cleaning system 100 also includes air pressure gauge 162 coupled to manifold 158 via conduit 166, and air compressor 164 coupled to manifold 158 via conduit 168. Air pressure gauge 162 can indicate the air pressure in air storage tank 156, and can be an air pressure gauge with an indication range of 0.0 psig to 100.0 psig. Air compressor 164 can fill air storage tank 156 with compressed air for air flushing and purging the oil lubrication system of vehicle engine 102. In one embodiment, air compressor 164 can be a 12.0 vdc air compressor with a fill capacity of approximately 0.8 to 1.5 cfm (cubic feet per minute). Air compressor 164 can fill air storage tank 156 during a dynamic cleaning cycle of dynamic oil flusher cleaning system 100. In one embodiment, while dynamic oil flusher cleaning system 100 is cleaning the oil lubrication system of vehicle engine 102 during a dynamic cleaning cycle, air compressor 164 may also fill air storage tank 156 at about the same time. Dynamic oil flusher cleaning system 100 further includes air pressure shutoff switch 172 coupled to manifold 158 via conduit 178, and air regulator 170 coupled to manifold 158 via conduit 174. Air pressure shutoff switch 172 can shutoff air compressor 164 when the air pressure in manifold 158 rises to a pre-set level, and turn on air compressor 164 when the air pressure in manifold 158 falls below a pre-set level. In one embodiment, air pressure shutoff switch 172 can shut off air compressor 164 when the air pressure in manifold 158 rises to approximately 110.0 psi, and air pressure shutoff switch 172 can turn on air compressor 164 when the air pressure in manifold 158 falls to approximately 70.0 psi. Air regulator 170 can provide a regulated air pressure of approximately 30.0 psi to air release solenoid 132 via conduit 176. In one embodiment, air regulator 170 can be a calibrated orifice that limits air pressure to a range of 25.0 psi to 30.0 psi. By providing a maximum regulated air pressure of approximately 30.0 psi, air regulator 170 can prevent damage to vehicle engine 102 during the air cleaning cycle of dynamic oil flusher cleaning system 100.

Dynamic oil flusher cleaning system 100 also includes timed air release control 142 coupled to air release solenoid 132 via line 144. Air release solenoid 132 can release a pressure-regulated air flow for air flushing and purging the oil lubrication system of vehicle engine 102 via conduit 138, valve 147, and return hose 124. In one embodiment, air release solenoid 132 can be a 12.0 vdc air release solenoid. Timed air release control 142 can provide a timed release of pressure-regulated air at air release solenoid 132 by controlling the length of time air release solenoid 132 is turned on. In one embodiment, timed air release control 142 can provide an approximate 20.0 to 30.0 second release of pressure-regulated air at air release solenoid 132. By limiting the release of pressure-regulated air to a range of approximately 20.0 to 30.0 seconds during the air cleaning cycle, dynamic oil flusher cleaning system 100 can prevent air pressure damage to the oil lubrication system of vehicle engine 102. In one embodiment, timed air release control 142 can be a timed delay relay, which operates under electromechanical control. In another embodiment, timed air release control 142 can be a microprocessor-controlled circuit with a programmable timed release interval.

Dynamic oil flusher cleaning system 100 also includes valve 147, which is coupled to air release solenoid 132 via conduit 138. Valve 147 allows pressure-regulated air to flow into return hose 124 via conduit 155, and prevents cleaning detergent solution from flowing into conduit 138 during the dynamic cleaning cycle. In one embodiment, valve 147 can be a 3.0-pound one-way check valve.

It should be noted that various inventive features of the present invention may be implemented in a static mode of operation (i.e., when the vehicle engine is not running), although the present invention is described in conjunction with an exemplary dynamic mode of operation (i.e., when the vehicle engine is running). For example, those of ordinary skill in the art understand that the air purging system described above can be used in conjunction with a static mode of operation as well.

Figure 2A:
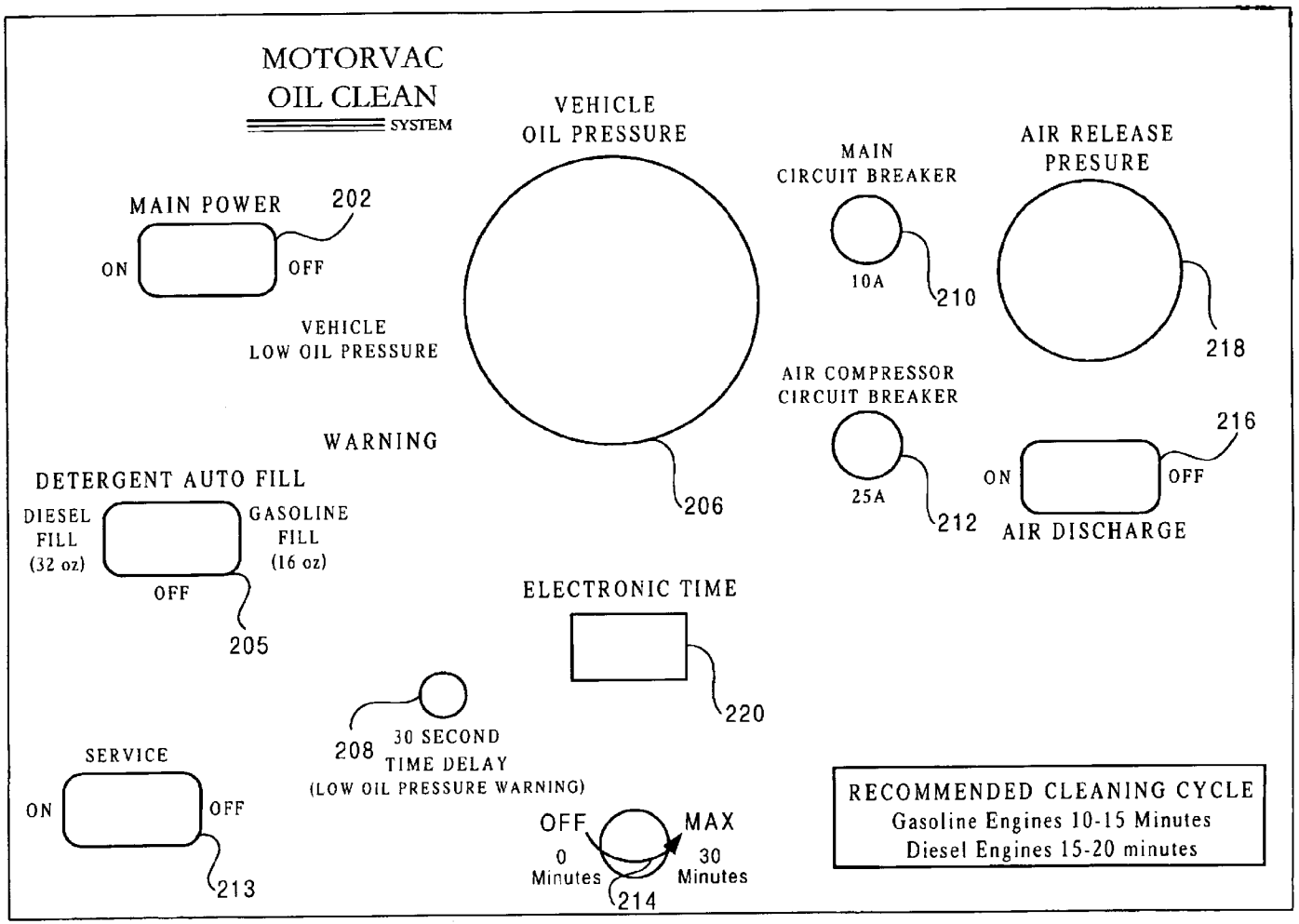
FIG. 2A illustrates an exemplary control panel for use in conjunction with the dynamic oil flusher cleaning system of FIG. 1.

FIG. 2A shows an exemplary control panel 200 in accordance with one embodiment of the present invention. Control panel 200 includes main power switch 202 for turning dynamic oil flusher cleaning system 100 in FIG. 1 on and off. In one embodiment, main power switch 202 can be an SPDT (single-pole/double-throw) switch with a panel indicator lamp. Control panel 200 also includes detergent auto fill switch 205 for selecting either a "diesel fill" position or a "gasoline fill" position to automatically fill solution housing 112 in FIG. 1 with an appropriate amount of cleaning detergent solution. For example, when detergent auto fill switch 205 is pressed in the "diesel fill" position, pump 106 turns on and pumps 32.0 ounces of cleaning detergent solution from solution tank 104 into solution housing 112. By way of further example, when detergent auto fill switch 205 is pressed in the "gasoline fill" position, pump 106 turns on and pumps 16.0 ounces of cleaning detergent solution from solution tank 104 into solution housing 112. In one embodiment, detergent auto fill switch 205 can be a three-position momentary contact switch with a panel indicator lamp and a center "off" position.

Control panel 200 also includes low oil pressure indicator lamp 208, which is lit when low oil pressure switch 130 in FIG. 1 detects low oil pressure in manifold 126. Control panel 200 also includes oil pressure gauge 206, which corresponds to oil pressure gauge 148 in FIG. 1. Control panel 200 further includes main circuit breaker 210 and air compressor circuit breaker 212. Main circuit breaker 210 can be a standard circuit breaker rated at 10.0 amperes, and air compressor circuit breaker 212 can be a standard circuit breaker rated at 20.0 to 25.0 amperes.

Control panel 200 further includes timer 214, which sets the run-time of the dynamic cleaning cycle of dynamic oil flusher cleaning system 100. In one embodiment, timer 214 can set the run-time of the dynamic cleaning cycle of dynamic oil flusher cleaning system 100 in one-minute increments, from one to thirty minutes. Timer 214 can be a mechanical or electrical timer connected to an alarm that sounds when the time set on the timer expires. Control panel 200 may also include electronic timer display 220 for displaying the remaining run-time of the dynamic cleaning cycle of dynamic oil flusher cleaning system 100. Timer display 220 can be a digital or LED display. In another embodiment timer 214 may be a mechanical timer.

Control panel 200 further includes air release pressure gauge 218 for measuring the pressure-regulated air discharged at air release solenoid 132 in FIG. 1. In one embodiment, air discharge pressure gauge 218 can have a range of 0.0 psig to 60.0 psig. Control panel 200 also includes air discharge switch 216 for releasing pressure-regulated air at air release solenoid 132 for air flushing and purging the oil lubrication system of a vehicle engine. In one embodiment, air discharge switch 216 can be a SPST (single-position/single-throw) momentary contact switch. Control panel 200 further includes service switch 213 for activating timer 214 and deactivating air discharge switch 216. For example, when service switch 213 is set to the "on" position, timer 214 is activated to allow it to be set to a desired run time. Also, when service switch 213 is set to the "off" position, air discharge switch 216 is deactivated and thus unable to release pressure-regulated air at air release solenoid 132.

Figures 2B, 2C:
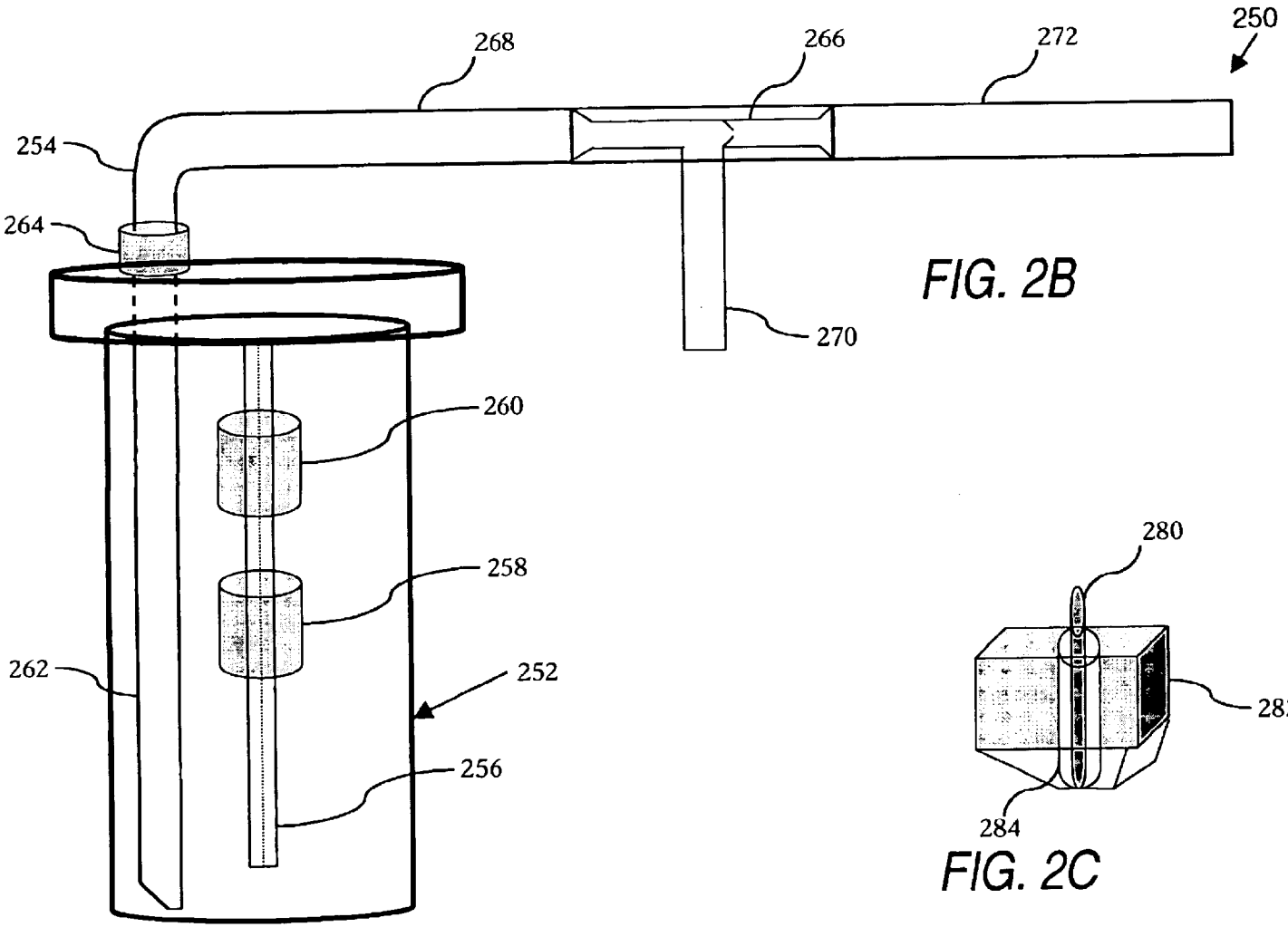
FIG. 2B illustrates an exemplary solution housing for use in conjunction with the dynamic oil flusher cleaning system of FIG. 1.
FIG. 2C illustrates an exemplary suction wand for use in conjunction with the dynamic oil flusher cleaning system of FIG. 1.

FIG. 2B shows an exemplary solution housing 250 in accordance with one embodiment of the present invention. Solution housing 250 includes solution housing 252 and suction assembly 254. Similar to solution housing 112 in FIG. 1, solution housing 252 includes a filter (not shown in FIG. 2B) for filtering contaminated cleaning detergent solution that flows through solution housing 252 when dynamic oil flusher cleaning system 100 is dynamically cleaning the oil lubrication system of a vehicle engine, such as vehicle engine 102 in FIG. 1.

Solution housing 252 further includes pump shutoff switch 256 for automatically shutting off a pump, such as pump 106 in FIG. 1, after the pump has dispensed a pre-determined amount of cleaning detergent solution into solution housing 252. Pump shutoff switch 256 includes float 258 and float 260 for indicating when pre-determined amounts of cleaning detergent solution has been dispensed into solution housing 252. In one embodiment, float 258 can indicate when 16.0 ounces of cleaning detergent solution has been dispensed into solution housing 252. In another embodiment, float 260 can indicate when 32.0 ounces of cleaning detergent solution has been dispensed into solution housing 252. Solution housing 252 can have the capacity to hold enough cleaning detergent solution to allow cleaning of an automotive crankcase having a 4.0 to 10.0 quart oil capacity.

Suction assembly 254 provides a means of removing residual waste oil out of solution housing 252 by sucking the residual waste oil out of solution housing 252 at the completion of servicing of an oil lubrication system of a vehicle engine by dynamic oil flusher cleaning system 100. Suction assembly 254 includes suction tube 262 for sucking residual waste oil out of solution housing 252. Suction assembly 254 also includes valve 264, which prevents residual waste oil from flowing back into solution housing 252 via suction tube 262. In other words, valve 264 allows residual waste oil to flow from suction tube 262 into conduit 268, but prevents residual waste oil from flowing in the reverse direction (i.e. from conduit 268 into solution housing 252 via suction tube 262).

Suction assembly 254 further includes venturi pump 266, which is in communication with valve 264 via conduit 268. Venturi pump 266 provides a suction source to remove residual waste oil from solution housing 252 via suction tube 262. Venturi pump 266 includes air input 270, which can be coupled to a pressurized air source, such as air storage tank 156 in FIG. 1, to power venturi pump 266. In other embodiments, conduit 268 can be coupled to a diaphragm, impeller, or centrifugal pump to provide a suction source to remove residual waste oil from solution housing 252. The diaphragm, impeller, or centrifugal pump may be controlled by a microprocessor. Suction assembly 254 also includes hose 272, which may be coupled to a waste storage tank (not shown in FIG. 2B) for disposal of the residual waste oil removed from solution housing 252. By pumping out residual waste oil from solution housing 252, suction assembly 254 eliminates the untidiness associated with draining the residual waste oil by opening a drainage means, as in conventional designs. Additionally, pumping out residual waste oil from solution housing 252 saves the service time that would be required to drain the residual waste via such drainage means.

FIG. 2C shows exemplary suction wand 280 in accordance with one embodiment of the present invention. Suction wand 280 can be inserted into dipstick tube 284 to remove waste oil from vehicle engine 282 at the completion of servicing of the oil lubrication system of vehicle engine 282 by dynamic oil flusher cleaning system 100. Suction wand 280 may be made of steel. Suction wand 280 can be coupled to a source of suction, such as venturi pump 266 in FIG. 2B. For example, suction wand 280 can be coupled to venturi pump 266 via conduit 268. In one embodiment, suction wand 280 may receive suction from an electric pump, which may function as a vacuum source. The electric pump might be a centrifugal, diaphragm, or impeller pump. In one embodiment, suction wand 280 may be coupled to an electric pump that is controlled by a microprocessor, such as microprocessor 570 in FIG. 5. Thus, in one embodiment, suction wand 280 can be coupled to a pump functioning as a vacuum source to evacuate contaminated oil out of vehicle engine 282 via dipstick tube 284 at the completion of servicing the oil lubrication system of vehicle engine 282 to avoid the untidiness associated with draining the contaminated oil out of a drain plug in the bottom of vehicle engine 282.

Figure 3:
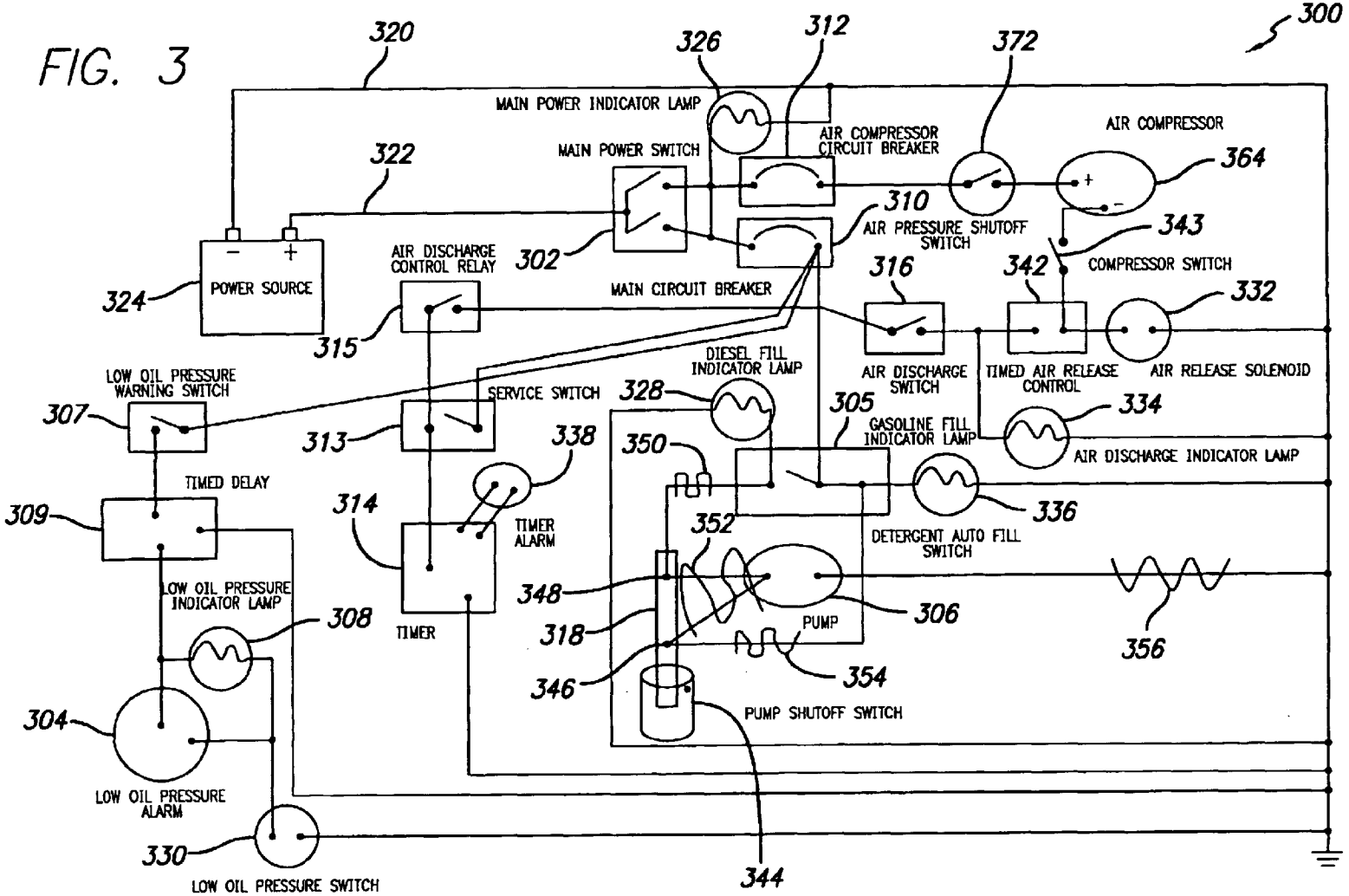
FIG. 3 illustrates an exemplary electrical schematic of a dynamic oil flusher cleaning system of FIG. 1.

Referring now to FIG. 3, electrical schematic 300 is shown for one embodiment of the present invention. Electrical schematic 300 shows negative power cable 320 and positive power cable 322 connected to power source 324. Power source 324 provides 12.0 vdc power to dynamic oil flusher cleaning system 100. Power source 324 can be a car battery. In one embodiment, power source 324 can be a 110.0 vac 50.0 or 60.0 cycle power source containing a 12.0 vdc power supply. It should be noted that in other embodiments power source 324 can a 220.0/240.0 vac 50.0 or 60.0 cycle power source containing a 12.0 vdc power supply, or a 24.0 vdc power source that is converted to 12.0 vdc by a step-down DC to DC voltage converter.

Electrical schematic 300 shows main power switch 302 for controlling 12.0 vdc power to dynamic oil flusher cleaning system 100. Electrical schematic 300 also shows main power indicator lamp 326 wired in series with main power switch 302 so that main power indicator lamp 326 is lit whenever main power switch 302 is in the "on" position. Electrical schematic 300 further shows air compressor circuit breaker 312 wired in series with main power switch 302 in order to protect air cleaning cycle electrical components, such as air compressor 364 and air release solenoid 332. Electrical schematic 300 also shows main circuit breaker 310 wired in series with main power switch 302 in order to protect all electrical components of electrical schematic 300 not protected by air compressor circuit breaker 312. Air compressor circuit breaker 312 and main circuit breaker 310, for example, can be fuses of a proper rating or standard switch type circuits. In one embodiment, main circuit breaker 310 is a pop-out circuit breaker with a current rating of 10.0 amperes and air compressor circuit breaker 312 is a pop-out circuit breaker with a current rating of 25.0 amperes.

Electrical schematic 300 shows service switch 313 and timer 314 connected in series with main power switch 302. Thus, when main power switch 302 is set to the "on" position and service switch 313 is closed (i.e. shorted), 12.0 vdc is applied to timer 314. When 12.0 vdc is applied to timer 314, timer 314 can run for a predetermined time. Electrical schematic 300 also shows timer alarm 338, which is wired to timer 314 so that timer alarm 338 will turn on when a predetermined run time set on timer 314 expires. For example, if timer 314 is set for a dynamic cleaning cycle run time of 10.0 minutes, at the expiration of 10.0 minutes timer alarm 338 will turn on to signal the completion of the dynamic cleaning cycle.

Electrical schematic 300 further shows low oil pressure alarm 304 and low oil pressure switch 330 connected in series with timed delay 309, low oil pressure warning switch 307, and main power switch 302. Low oil pressure warning switch 307 is normally closed and will allow 12.0 vdc to trigger timed delay 309 when main power switch 302 is set to the "on" position. In one embodiment, low oil pressure warning switch 307 is a SPST (single-pole/single-throw) momentary contact switch. When timed delay 309 is triggered, timed delay 309 provides 12.0 vdc to low oil pressure alarm 304 after an approximate 30.0 second delay. In one embodiment, timed delay 309 can be a timed relay with contacts that provide an approximate 30.0 second delay before closing after the timed relay is energized. In such instance, when main power switch 302 is set to the "on" position, the contacts on the timed relay will close after approximately 30.0 seconds.

When 12.0 vdc is provided to low oil pressure alarm 304, low oil pressure alarm 304 will activate when low oil pressure switch 330 closes (i.e. shorts). Low oil pressure switch 330 will close when oil pressure in a vehicle engine being serviced falls to a predetermined level. In one embodiment, low oil pressure switch 330 will close when vehicle engine oil pressure falls to a level of 5.0 psi. Thus, approximate 30.0 seconds after timed delay 309 is triggered, a low vehicle engine oil pressure level will cause low oil pressure switch 330 to close and activate low oil pressure alarm 304. When low oil pressure switch 330 closes, low oil pressure indicator lamp 308, which is in series with low oil pressure switch 330, will also light to visually indicate a low vehicle engine oil pressure level.

Electrical schematic 300 also shows detergent auto fill switch 305 wired in series with main power switch 302. When main power switch 302 is set to the "on" position, 12.0 vdc is applied to the center terminal of detergent auto fill switch 305. Electrical schematic 300 further shows detergent auto fill switch 305 connected in series with pump shutoff switch 318 and pump 306. In electrical schematic 300, pump shutoff switch 318 is a mechanical float switch comprising float 344 and normally closed sensor switches 346 and 348. It is appreciated, however, that in other embodiments pump shutoff switch 318 can be an optical, magnetic, reed, proximity, or variable resistance sensor switch. Pump shutoff switch 318 can be situated inside a solution housing, such as solution housing 112 in FIG. 1 that can receive a cleaning detergent mixture. Sensor switches 346 and 348 can each be appropriately positioned on pump shutoff switch 318 to open when cleaning detergent mixture causes float 344 to rise to a pre-determined level inside solution housing 112.

In the present embodiment, detergent auto fill switch 305 can be in a "diesel fill" position, a center "off" position, or a "gasoline fill" position. For example, when main power switch 302 is in the "on" position and detergent auto fill switch 305 is in the "diesel fill" position, 12.0 vdc is applied to pump shutoff switch 318 at sensor switch 348, and pump 306, which is in series with sensor switch 348, turns on. When pump 306 turns on, it begins pumping cleaning detergent solution into a solution housing, such as solution housing 112 in FIG. 1, causing float 344 to rise. When the amount of cleaning detergent solution in the solution housing causes float 344 to rise to the level of sensor switch 348, sensor switch 348 will open and shut off pump 306. Thus, by appropriately setting the position of sensor switch 348 on pump shutoff switch 318, the amount of cleaning detergent solution that is pumped into solution housing 112 can be controlled. In one embodiment, the position of sensor position 348 is set to allow pump 306 to pump 32.0 ounces of cleaning detergent solution into solution housing 112 when detergent auto fill switch 305 is set to the "diesel fill" position.

Similarly, when detergent auto fill switch 305 is set to the "gasoline" fill position, pump 306 will continue to pump cleaning detergent solution into solution housing 112 until float 344 rises to the level of sensor switch 346, which causes sensor switch 346 to open and shut off pump 306. In one embodiment, the position of sensor switch 346 is set to allow pump 306 to pump 16.0 ounces of cleaning detergent solution into solution housing 112 when detergent auto fill switch 305 is set to the "gasoline fill" position. Electrical schematic 300 further shows diesel fill indicator lamp 328 wired in series with detergent auto fill switch 305 in the "diesel fill" position, and gasoline fill indicator lamp 336 wired in series with detergent auto fill switch 305 in the "gasoline fill" position. Thus, when detergent auto fill switch 305 is in the "diesel fill" position, diesel fill indicator lamp 328 will light, and when detergent auto fill switch 305 is in the "gasoline fill" position, gasoline fill indicator lamp 336 will light.

Electrical schematic 300 further shows air compressor 364 wired in series with main power switch 302, air pressure shutoff switch 372, compressor switch 343, and air release solenoid 332. Air compressor 364 and air pressure shutoff switch 372 are coupled via conduits to a manifold, such as manifold 158 in FIG. 1, that provides pressurized air for use in an air cleaning cycle of dynamic oil flusher cleaning system 100. In electrical schematic 300, air pressure shutoff switch 372 is a differential pressure switch that will open when air pressure in the manifold air pressure shutoff switch 372 is coupled to rises above approximately 110.0 psi, and will close when the air pressure in the manifold falls below approximately 70.0 psi.

Thus, when main power switch 302 is in the "on" position and compressor switch 343 is closed, air pressure shutoff switch 372 will close and turn on air compressor 364 when the air pressure in the above manifold falls below approximately 70.0 psi. When the air pressure in the manifold rises above approximately 110.0 psi, air pressure shutoff switch 372 will open and turn off air compressor 364. In one embodiment, compressor switch 343 is open when timed air release control 342 is energized (i.e. during the air cleaning cycle of dynamic oil flusher cleaning system 100).

Electrical schematic 300 also shows timed air release control 342 wired in series with air release solenoid 332 and air discharge switch 316. Air discharge switch 316 is also wired in series with air discharge control relay 315, service switch 313, and main power switch 302. In the present embodiment, timed air release control 342 closes (i.e. shorts) when energized, and remains closed for approximately 20.0 to 30.0 seconds before opening. In one embodiment, timed air release control 342 can be a timed relay. In another embodiment, timed air release control 342 can be a microprocessor-controlled circuit with a programmable time delay.

Air discharge control relay 315 is controlled by service switch 313. For example, when service switch 313 is open, air discharge control relay 315 is closed, and when service switch 313 is closed, air discharge control relay 315 is open. Thus, when main power switch 302 is in the "on" position, service switch 313 is open, and air discharge control relay 315 and air discharge switch 316 are closed, timed air release control 342 will energize and turn on air release solenoid 332 for approximately 20.0 to 30.0 seconds. At the expiration of approximately 20.0 to 30.0 seconds, timed air release control 342 will open and turn off air release solenoid 332. Electrical schematic 300 further includes air discharge indicator lamp 334 wired in series with air discharge switch 316. Thus, air discharge indicator lamp 334 will light when main power switch 302 is in the "on" position and air discharge switch 316, air discharge relay 315, and service switch 313 are closed. Electrical schematic 300 further shows inductor filter coils 350, 352, 354, and 356. Inductor filter coils 350, 352, 354, and 356 can be pass-through filters for eliminating electromagnet interference ("EMI") produced by pump 306.

In one embodiment, a microprocessor chip, such as those manufactured by Intel, Motorola, AMD, etc., can be used to control dynamic oil flusher cleaning system 100. The microprocessor chip can control a digital display or membrane keypad with LED indicators and an audible alert alarm.

Figure 4:
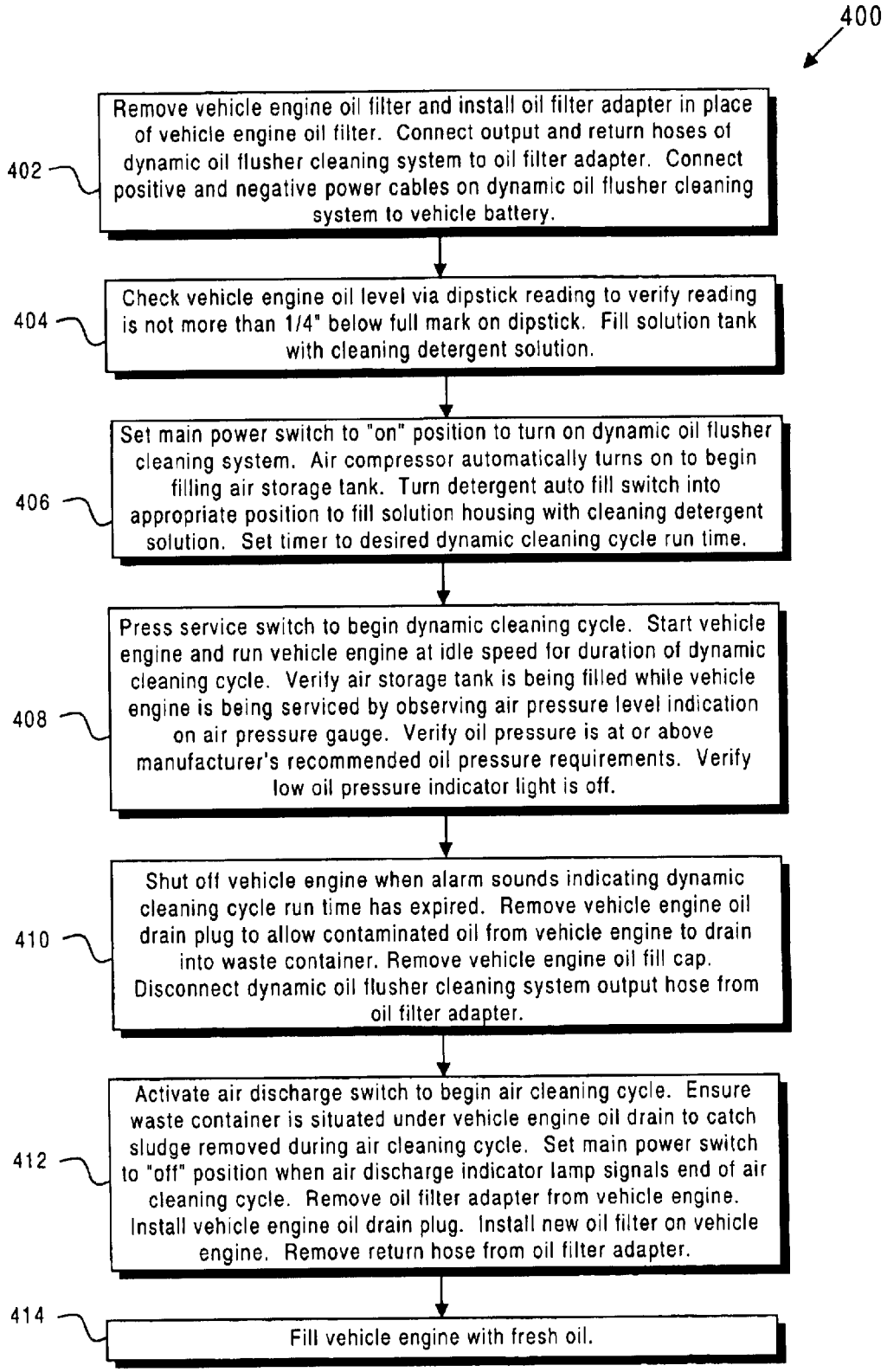
FIG. 4 illustrates an exemplary flow diagram for use in conjunction with the dynamic oil flusher cleaning system of FIG. 1.

Turning to FIG. 4, flowchart 400 shows example steps for cleaning a vehicle engine oil lubrication system using dynamic oil flusher cleaning system 100. As shown in FIG. 4, in step 402 an oil filter can be removed from a vehicle engine to be serviced, and oil filter adapter 120 in FIG. 1 can be installed in place of the oil filter. Output hose 122 and return hose 124 can be connected to oil filter adapter 120, and positive and negative power cables of dynamic oil flusher cleaning system 100 can be connected to the appropriate terminals of a 12.0 vdc vehicle battery. In one embodiment, the positive and negative power cables of dynamic oil flusher cleaning system 100 can be connected to the appropriate terminals of a 12.0 vdc power supply. In another embodiment, the positive and negative power cables of dynamic oil flusher cleaning system 100 can be connected to the appropriate terminals of a 24.0 vdc vehicle battery via a 24.0 vdc to 12.0 vdc converter.

In step 404, the vehicle engine oil level can be checked via a dipstick reading to verify that the dipstick reading is not more than ¼" below the full mark on the dipstick. If the dipstick reading is more than ¼" below the full mark, oil may be added to the vehicle engine to raise the vehicle engine oil level to the appropriate level. Solution tank 104 in FIG. 1 can be filled with cleaning detergent solution. In step 406, main power switch 202 in FIG. 2A is set to the "on" position to turn on dynamic oil flusher cleaning system 100. Air compressor 164 will automatically turn on to begin filling air storage tank 156.

Next, detergent auto fill switch 205 is pressed in an appropriate position to fill solution housing 112 with an amount of cleaning detergent solution needed for the type of vehicle engine being serviced. For example, detergent auto fill switch 205 can be pressed in the "diesel fill" position to fill solution housing 112 with 32.0 ounces of cleaning detergent solution for servicing a diesel vehicle engine. By way of further example, to service a gasoline vehicle engine, detergent auto fill switch 205 can be pressed in the "gasoline fill" position to fill solution housing 112 with 16.0 ounces of cleaning detergent solution. Next, timer 214 can be set for a desired dynamic cleaning cycle run time. For example, a run time of 10.0 minutes can be set on timer 214 to allow the dynamic cleaning cycle to run for 10.0 minutes.

In step 408, service switch 313 is activated to begin a dynamic cleaning cycle. The vehicle engine is started and set to run at idle speed for the duration of the dynamic cleaning cycle. When the vehicle engine is started, the oil pump in the vehicle engine pumps cleaning detergent solution from solution housing 112 into the vehicle engine via output hose 122. The cleaning detergent solution is mixed with contaminated oil in the vehicle engine oil lubrication system. Contaminated oil and cleaning detergent mixture is pumped out of the vehicle engine via return hose 124. The contaminated oil and cleaning detergent mixture is then pumped by the vehicle engine oil pump into solution housing 112 via valve 152, conduit 151, manifold 126, conduit 140, valve 134, conduit 146, tee fitting 149, and conduit 154. Solution housing 112 filters the contaminated oil and cleaning detergent mixture, which is then pumped back into the vehicle engine via output hose 122. The oil and cleaning detergent mixture continues to circulate through dynamic oil flusher cleaning system 100 as described above for the duration of the dynamic cleaning cycle.

The air pressure level indication on air pressure gauge 162 can be observed to verify that air storage tank 156 is being filled while the vehicle engine is being serviced. Oil pressure gauge 206 can be read to verify vehicle engine oil pressure is at or above manufacturer's recommended oil pressure requirements. Adequate vehicle engine oil pressure can also be verified by observing that low oil pressure indicator lamp 208 is not lit.

In step 410, the vehicle engine being serviced is shut off when timer 214 sounds an alarm indicating dynamic cleaning cycle run time has expired (i.e. the dynamic cleaning cycle is over). In one embodiment, the time required to perform a typical dynamic cleaning of a vehicle engine can be 10.0 to 15.0 minutes for a gasoline vehicle engine and 15.0 to 20.0 minutes for a diesel vehicle engine. Next, the vehicle engine oil drain plug should be removed to drain contaminated oil from the vehicle engine into a waste container. The vehicle engine oil fill cap may be removed, and dynamic oil flusher cleaning system 100 output hose 122 may be disconnected from oil filter adapter 120.

In step 412, air discharge switch 216 on control panel 200 is activated to begin an air cleaning cycle. In one embodiment, air discharge switch 216 can be pressed and released to begin an approximate 20.0 to 30.0 second air cleaning cycle. During the air cleaning cycle a stream of pressure-regulated air flows through return hose 124 into the vehicle engine. A waste container should be situated under the vehicle engine oil drain to catch sludge removed during the air cleaning cycle. The air cleaning cycle of dynamic oil flusher cleaning system 100 can remove additional sludge from the vehicle engine by reverse flushing the vehicle engine oil pump screen and internal engine passageways with a stream of pressure-regulated air. For example, an additional pint of sludge can be removed from the vehicle engine and drained through the vehicle engine oil drain into a waste container during the air cleaning cycle. Main power switch 302 may be set to the "off" position when air discharge indicator lamp 334 signals the completion of the air cleaning cycle. Next, oil filter adapter 120 can be removed from the vehicle engine, and the vehicle engine oil drain plug can be installed. A new oil filter may be installed on the vehicle engine, and return hose 124 can be removed from oil filter adapter 120. In step 414, the vehicle engine may be filled with fresh oil and the vehicle engine oil fill cap may be replaced.

Figure 5:
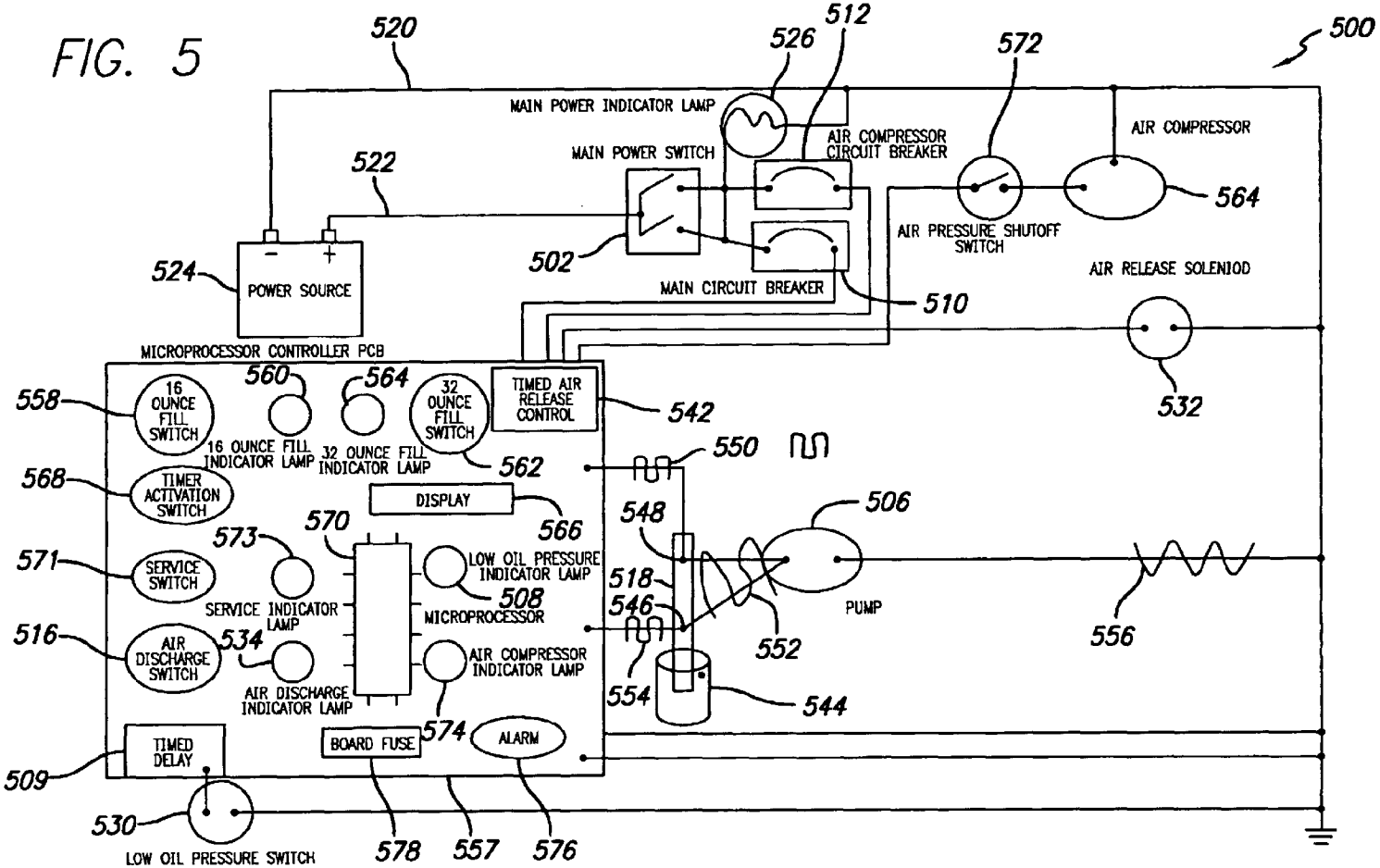
FIG. 5 illustrates an exemplary electrical schematic of a dynamic oil flusher cleaning system of FIG. 1.

Turning now to FIG. 5, electrical schematic 500 is shown for one embodiment of the present invention. In electrical schematic 500, power source 524, negative power cable 520, positive power cable 522, main power switch 502, main power indicator lamp 526, air compressor circuit breaker 512, and main circuit breaker 510, respectively, perform similar functions as power source 324, negative power cable 320, positive power cable 322, main power switch 302, main power indicator lamp 326, air compressor circuit breaker 312, and main circuit breaker 310 in electrical schematic 300 in FIG. 3. Also, air pressure shutoff switch 572, air compressor 564, air release solenoid 532, pump 506, pump shutoff switch 518, float 544, sensor positions 546 and 548, low oil pressure switch 530, and inductor filter coils 550, 552, 554, and 556, respectively, perform similar functions as air pressure shutoff switch 372, air compressor 364, air release solenoid 332, pump 306, pump shutoff switch 318, float 344, sensor positions 346 and 348, low oil pressure switch 330, and inductor filter coils 350, 352, 354, and 356 in electrical schematic 300.

Electrical schematic 500 includes microprocessor controller printed circuit board (PCB) 557. Although included on microprocessor controller PCB 557, low oil pressure indicator lamp 508, timed delay 509, air discharge switch 516, air discharge indicator lamp 534, and timed air release control 542, respectively, perform similar functions as low oil pressure indicator lamp 308, timed delay 309, air discharge switch 316, air discharge indicator lamp 334, and timed air release control 342 in electrical schematic 300. Microprocessor controller PCB 557 also includes 16.0 ounce fill switch 558 for filling solution housing 112 in FIG. 1 with 16.0 ounces of cleaning detergent solution. For example, when 16.0 ounce fill switch 558 is activated, pump 506 will turn on and pump 16.0 ounces of cleaning detergent solution into solution housing 112, causing float 544 to rise. When float 544 rises to the level of sensor switch 546, sensor switch 546 will open and shut off pump 506.

Microprocessor controller PCB 557 further includes 32.0 ounce fill switch 562 for filling solution housing 112 with 32.0 ounces of cleaning detergent solution. For example, when 32.0 ounce fill switch 562 is activated, pump 506 will turn on and pump 16.0 ounces of cleaning detergent solution into solution housing 112, causing float 544 to rise. When float 544 rises to the level of sensor switch 548, sensor switch 548 will open and shut off pump 506. 16.0 ounce fill switch 558 and 32.0 ounce fill switch 562 can be momentary contact button switches. Microprocessor controller PCB 557 also includes 16.0 ounce fill indicator lamp 560 and 32.0 ounce fill indicator lamp 564. When 16.0 ounce fill switch 558 is activated, 16.0 ounce fill indicator lamp 560 will light, and when 32.0 ounce fill switch 562 is activated, 32.0 ounce fill indicator lamp 564 will light.

Microprocessor controller PCB 557 also includes display 566 and microprocessor 570. Display 566 can be controlled by microprocessor 570, and may be a digital display or a membrane keypad with LED indicators. Microprocessor 570 can be a microprocessor chip, such as those manufactured by Intel, Motorola, AMD, etc., which is used to control dynamic oil flusher cleaning system 100.

Microprocessor 570 may include a sequential control circuit to enable an operator to utilize pressurized air in dynamic oil flusher cleaning system 100 to force residual oil out of solution housing 112 after completion of service of a vehicle engine oil lubrication system. For example, the sequential control circuit may activate air release solenoid 132 and open valve 152 to allow pressurized air to flow into solution housing 112 to force waste oil out of solution housing 112 when an operator opens a petcock on the bottom of solution housing 112 and presses air discharge switch 516. The pressurized air can flow into solution housing 112 via valve 147, conduit 155, return hose 124, valve 152, conduit 151, manifold 126, conduit 140, valve 134, conduit 146, tee fitting 149, and conduit 154.

Microprocessor 570 may further include software for performing maintenance functions in dynamic oil flusher cleaning system 600. In one embodiment, microprocessor 570 may include software to enable air condensation to be purged in air compressor 164 by activating air release solenoid 132 when output hose 122 and return hose 124 in FIG. 1 are vented to atmosphere. In one embodiment, microprocessor 570 may include software for testing electrical and electro-mechanical circuits of dynamic oil flusher cleaning system 100 each time dynamic oil flusher cleaning system 100 is powered up. For example, the electrical and electromechanical circuits of dynamic oil flusher cleaning system 100 may be tested by scanning the electromechanical circuits at power up of dynamic oil flusher cleaning system 100. If anomalies are detected in the electrical and electromechanical circuits of dynamic oil flusher cleaning system 100, fault codes that correspond to the anomalies may be displayed on display 566.

Microprocessor controller PCB 557 further includes timer activation switch 568 for setting the run time of dynamic oil flusher cleaning system 100 on an electronic timer (not shown in FIG. 5). In one embodiment, timer activation switch 568 sets the run time of dynamic oil flusher cleaning system 100 in 5.0 minute increments, with a maximum run time of approximately 30.0 minutes. The run time set on the electronic timer (not shown in FIG. 5) can be displayed on display 566.

Microprocessor controller PCB 557 also includes service switch 571, service indicator lamp 573, and alarm 576. Service switch 571 activates alarm 576 and provides power to the electronic timer to allow a desired run time of the dynamic cleaning cycle of dynamic oil flusher cleaning system 100 to be set. Service indicator lamp 573 lights when service switch 571 is activated. In one embodiment, when service switch 571 is activated, air release solenoid 532 is locked out to prevent release of pressure-regulated air during the dynamic cleaning cycle of dynamic oil flusher cleaning system 100. In one embodiment, alarm 576 provides an audible tone to signal the expiration of the dynamic cleaning cycle run time, and further provides an alternating audible tone (i.e. one second on and one second off) to signal a low oil pressure indication triggered by low oil pressure switch 530.

Microprocessor controller PCB 557 further includes air compressor indicator lamp 574 and board fuse 578. Air compressor indicator lamp 574 lights to indicate air compressor 564 is turned on. Board fuse 578 provides protection for the electrical components on microprocessor controller PCB 557, and may be a fuse of a proper rating or standard switch type circuit breaker. In one embodiment, board fuse 578 may be a solid state fuse that can automatically reset approximately 5.0 seconds after the short circuit or overload condition that caused the fuse to trip has been corrected.

Figure 6A:
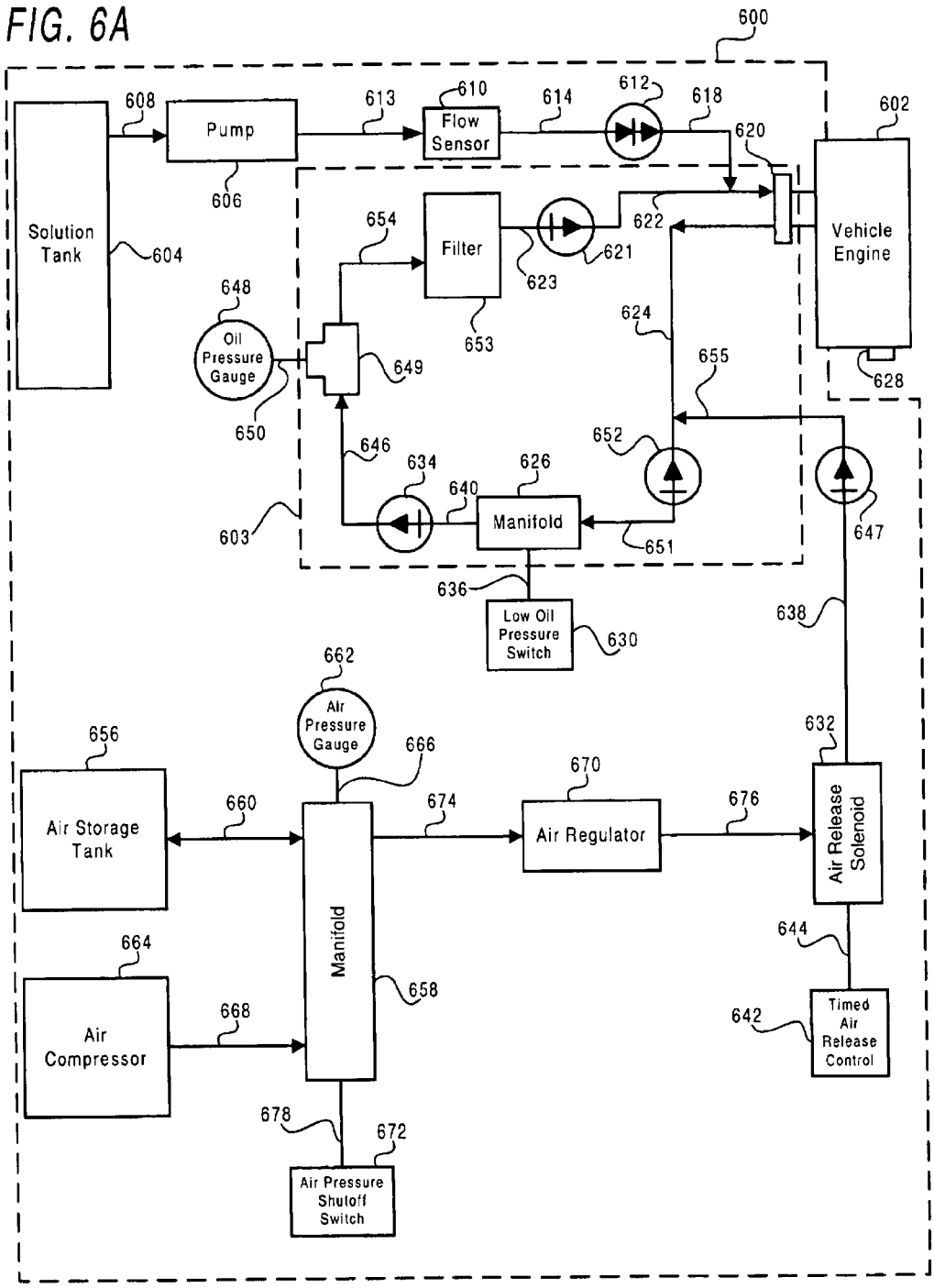
FIG. 6A illustrates an exemplary diagram of a dynamic oil flusher cleaning system according to one embodiment of the present invention.

FIG. 6A shows a detailed diagram of dynamic oil flusher cleaning system 600 according to one embodiment of the present invention. As shown in FIG. 6A, dynamic oil flusher cleaning system 600 can be connected to vehicle engine 602 for servicing the oil lubrication system of vehicle engine 602. Dynamic oil flusher cleaning system 600 uses a dynamic cleaning cycle to clean the oil passageways of a diesel or gasoline vehicle engine by circulating cleaning detergent solution through the vehicle engine oil lubrication system while the vehicle engine is running. Dynamic oil flusher cleaning system 600 also uses an air cleaning cycle to back flush and clean the vehicle engine oil lubrication system by injecting a stream of pressure-regulated air into the vehicle engine oil lubrication system. In other embodiments, dynamic oil flusher cleaning system 600 can be reconfigured to clean a vehicle's transmission, hydraulic, and coolant fluid systems, or other pressurized fluid system requiring cleaning or flushing. It is noted that the components of dynamic oil flusher cleaning system 600 enclosed by dashed box 603 are collectively referred to as a "cleaning detergent flow loop" in the present application.

Dynamic oil flusher cleaning system 600 includes solution tank 604 and pump 606. Solution tank 604 may contain a cleaning detergent solution for cleaning a vehicle engine oil lubrication system. The cleaning detergent solution can be pumped out of solution tank 604 by pump 606, which is coupled to solution tank 604 via conduit 608. In one embodiment, solution tank 604 may also contain fresh oil for filling the vehicle engine oil lubrication system. Pump 606 can be a 12.0 vdc 1.0 gpm (gallons per minute) diaphragm pump. In one embodiment, pump 606 can be a 12.0 vdc pump with a diaphragm comprised of "Viton" material. Solution tank 604 may include a fill port (not shown in FIG. 6A) for adding cleaning detergent solution. In one embodiment, solution tank 604 may be made of a clear material to allow the fluid solvent solution level in solution tank 604 to be visually determined. In one embodiment, pump 606 may be controlled by a microprocessor, such as microprocessor 570 in FIG. 5, to start in order to pump cleaning detergent solution into vehicle engine 602 and to stop after a pre-determined amount of cleaning detergent solution has been pumped into vehicle engine 602 by pump 606. For example, pump 606 may be controlled by the microprocessor to close after pump 606 has dispensed about 16.0 or 32.0 ounces of cleaning detergent solution for cleaning the vehicle engine oil lubrication system.

Dynamic oil flusher cleaning system 600 also includes flow sensor 610 for measuring the amount of cleaning detergent solution dispensed into vehicle engine 602 by pump 606, which is coupled to flow sensor 610 via conduit 613. Flow sensor 610 can be a digital flow sensor, such as a Hall Effect Turbine Flow Sensor capable of electronically metering the amount of cleaning detergent solution dispensed by pump 606 into vehicle engine 602. In one embodiment, vehicle engine 602 is off while pump 606 is dispensing cleaning detergent solution into vehicle engine 602. Flow sensor 610 can communicate to a microprocessor (not shown in FIG. 6A), such as microprocessor 570 in FIG. 5, the amount of cleaning detergent solution dispensed into vehicle engine 602. For example, microprocessor 570 can receive a signal from flow sensor 610 and count number of pulses on that signal to determine the amount of cleaning detergent solution dispensed by pump 606 into vehicle engine 602.

Dynamic oil flusher cleaning system 600 further includes shut-off solenoid 612, which is coupled to flow sensor 610 via conduit 614. Shut-off solenoid 612 prevents cleaning detergent solution from solution tank 604 from entering conduit 618 when shut-off solenoid 612 is closed. In other words, shut-off solenoid 612 prevents flow of fluid between conduit 614 and conduit 618 when in closed position. In one embodiment, shut-off solenoid 612 can be a 12.0 vdc shut-off solenoid. Shut-off solenoid 612 may be controlled by a microprocessor, such as microprocessor 570 in FIG. 5, to open in order to pump cleaning detergent solution into vehicle engine 602 and to close after a pre-determined amount of cleaning detergent solution has been pumped into vehicle engine 602 by pump 606. For example, shut-off solenoid 612 may be controlled by a microprocessor to close after pump 606 has dispensed about 16.0 or 32.0 ounces of cleaning detergent solution for cleaning the vehicle engine oil lubrication system. In one embodiment, shut-off solenoid 612 is activated during dispensing cleaning detergent solution using pulse signal from flow sensor 610.

In one embodiment, detergent auto fill switch 205 in FIG. 2A can be pressed in the "gasoline fill" position to begin dispensing cleaning detergent solution into vehicle engine 602. In response, the microprocessor starts pump 606 and opens shut-off solenoid 612 to pump cleaning detergent solution into vehicle engine 602. In the meantime, the microprocessor determines the amount of cleaning detergent solution pumped into vehicle engine 602 using a signal from flow sensor 610. When the microprocessor determines that 16.0 ounces of cleaning detergent solution have been dispensed into vehicle engine 602 via conduit 614, the microprocessor stops pump 606 and closes shut-off solenoid 612 to cut off the flow of cleaning detergent solution.

In another mode of operation, detergent auto fill switch 205 in FIG. 2A may be pressed in the "diesel fill" position to begin dispensing cleaning detergent solution into vehicle engine 602. Accordingly, when the microprocessor determines that 32.0 ounces of cleaning detergent solution have been dispensed into vehicle engine 602 via conduit 614, the microprocessor stops pump 606 and closes shut-off solenoid 612 to cut off the flow of cleaning detergent solution.

As shown, shut-off solenoid 612 is coupled to output hose 622 via conduit 618, and output hose 622 is connected to oil filter adapter 620 via a connector (not shown in FIG. 6A), which is attached to an end of output hose 622. The connector attached to the end of output hose 622 is similar to the connector attached to an end of output hose 122 in FIG. 1. In one embodiment, shut-off solenoid 612 may be coupled to return hose 624 via conduit 618 to allow cleaning detergent solution flowing through conduit 618 to enter vehicle engine 602 via return hose 624.

Return hose 624 is connected to oil filter adapter 620 via a connector (not shown in FIG. 6A), which is attached to an end of return hose 624. The connector attached to the end of return hose 624 is similar to the connector attached to an end of return hose 122 in FIG. 1. Oil filter adapter 620 couples output hose 622 and return hose 624 of dynamic oil flusher cleaning system 600 to the oil lubrication system of vehicle engine 602. In one embodiment, output hose 622 and return hose 624 can be clear hoses in which oil flow may be visually detected. In one embodiment, oil filter adapter 620 can use internal thread inserts and outer sealing adapter plates with various size o-rings to provide proper coupling to a vehicle engine. Oil filter adapter 620 can be connected to vehicle engine 602 by installing oil filter adapter 620 in place of vehicle engine 602 oil filter (not shown in FIG. 6A). Vehicle engine 602 includes oil drain plug 628, which can be removed to drain oil from vehicle engine 602.

Dynamic oil flusher cleaning system 600 further includes valve 652, which couples return hose 624 to conduit 651. Valve 652 allows cleaning detergent solution to flow from return hose 624 through conduit 651 during a dynamic cleaning cycle (i.e. when cleaning detergent solution is circulating through the oil lubrication system of vehicle engine 602). During an air cleaning cycle (i.e. when pressure-regulated air is used to back flush and clean the oil lubrication system of vehicle engine 602), valve 652 prevents pressure-regulated air from flowing into conduit 651. In one embodiment, valve 652 can be a 12.0 vdc solenoid operated control valve. In one embodiment, valve 652 may not be used.

Dynamic oil flusher cleaning system 600 further includes manifold 626, low oil pressure switch 630, and valve 634. Manifold 626 is connected to valve 652 via conduit 651, and can be a 3-port manifold. Low oil pressure switch 630, which is coupled to manifold 626 via conduit 636, can provide a warning when the oil pressure in manifold 626 falls below a specified level. For example, low oil pressure switch 630 can sound an alarm on a control panel (not shown in FIG. 6A), such as control panel 200 in FIG. 2A, when oil pressure in manifold 626 falls below 5.0 psi (pounds per square inch). In one embodiment, low oil pressure switch 630 can be a 0.0 psig to 5.0 psig (pounds per square inch gauge) switch. In another embodiment, low oil pressure switch 630 can be an oil-sending unit. Valve 634 can prevent cleaning detergent solution from flowing back to manifold 626 via conduit 640, which couples manifold 626 to valve 634. In other words, valve 634 allows cleaning detergent solution to flow from manifold 626 into conduit 646 via conduit 640, but prevents cleaning detergent solution from flowing in the reverse direction (i.e. from conduit 646 to manifold 626 via conduit 640). In one embodiment, valve 634 can be a 3.0-pound one-way check valve. Further, in some embodiments, valve 634 is not utilized.

Dynamic oil flusher cleaning system 600 further includes oil pressure gauge 648 for measuring the oil pressure of vehicle engine 602. In one embodiment, oil pressure gauge 648 can have a range of 0.0 psig to 100.0 psig. Tee fitting 649 is coupled to oil pressure gauge 648 via conduit 650, and is further coupled to filter 653 via conduit 654. Filter 653 filters contaminated cleaning detergent solution that flows through filter 653 when dynamic oil flusher cleaning system 600 is dynamically cleaning the oil lubrication system of vehicle engine 602. Filter 653 can be a high absorption rate material, such as cellulose, polyester, paper or cotton. In one embodiment, filter 653 is a single-use disposable 5.0 micron filter for cleaning either diesel or gasoline vehicle engine oil lubrication systems.

Dynamic oil flusher cleaning system 600 also includes valve 621 coupled to filter 653 via conduit 623. Valve 621 can prevent cleaning detergent solution from flowing back through conduit 623 via output hose 622, which couples valve 621 to oil filter adapter 620. Valve 621 also prevents cleaning detergent solution from flowing back through conduit 623 via conduit 618, which couples shut-off solenoid 612 to output hose 622. In one embodiment, valve 621 can be a 3.0-pound one-way check valve. In one embodiment, valve 621 is not used, and output hose 622 couples filter 653 to oil filter adapter 620.

Dynamic oil flusher cleaning system 600 further includes air release solenoid 632, timed air release control 642, valve 647, air storage tank 656, manifold 658, air pressure gauge 662, air compressor 664, air regulator 670, and air pressure shutoff switch 672, which respectively correspond to air release solenoid 132, timed air release control 142, valve 147, air storage tank 156, manifold 158, air pressure gauge 162, air compressor 164, air regulator 170, and air pressure shutoff switch 172 in FIG. 1.

Figure 6B:
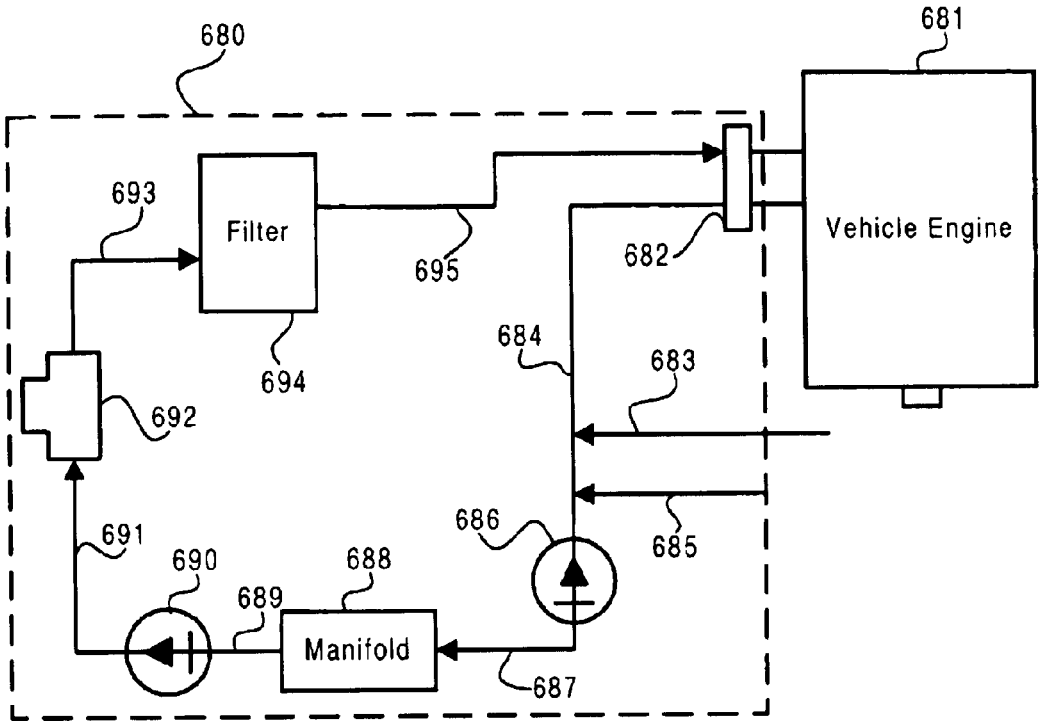
FIG. 6B illustrates an exemplary diagram of a portion of a dynamic oil flusher cleaning system according to one embodiment of the present invention.

FIG. 6B shows a detailed diagram of a portion of a dynamic oil flusher cleaning system according to one embodiment of the present invention. As shown in FIG. 6B, dashed box 680 can replace dashed box 603 in FIG. 6A and form the cleaning detergent flow loop of dynamic oil flusher cleaning system 600. Thus, in one embodiment, the configuration of elements in dashed box 680 can replace the elements enclosed by dashed line 603 in FIG. 6A.

Dashed box 680 includes oil filter adapter 682, return hose 684, conduits 683, 685, 687, 689, 691, and 693, valves 686 and 690, manifold 688, tee fitting 692, filter 694, and output hose 695, which respectively correspond to oil filter adapter 620, return hose 624, conduits 618, 655, 651, 640, 646, and 654, valves 652 and 634, manifold 626, tee fitting 649, filter 653, and output hose 622 in FIG. 6A. As shown in dashed box 680, cleaning detergent solution is dispensed into vehicle engine 681 via conduit 683 and return hose 684. While cleaning detergent solution is being dispensed into vehicle engine 681, valve 652 is closed to prevent cleaning detergent solution from entering conduit 651.

Figure 6C:
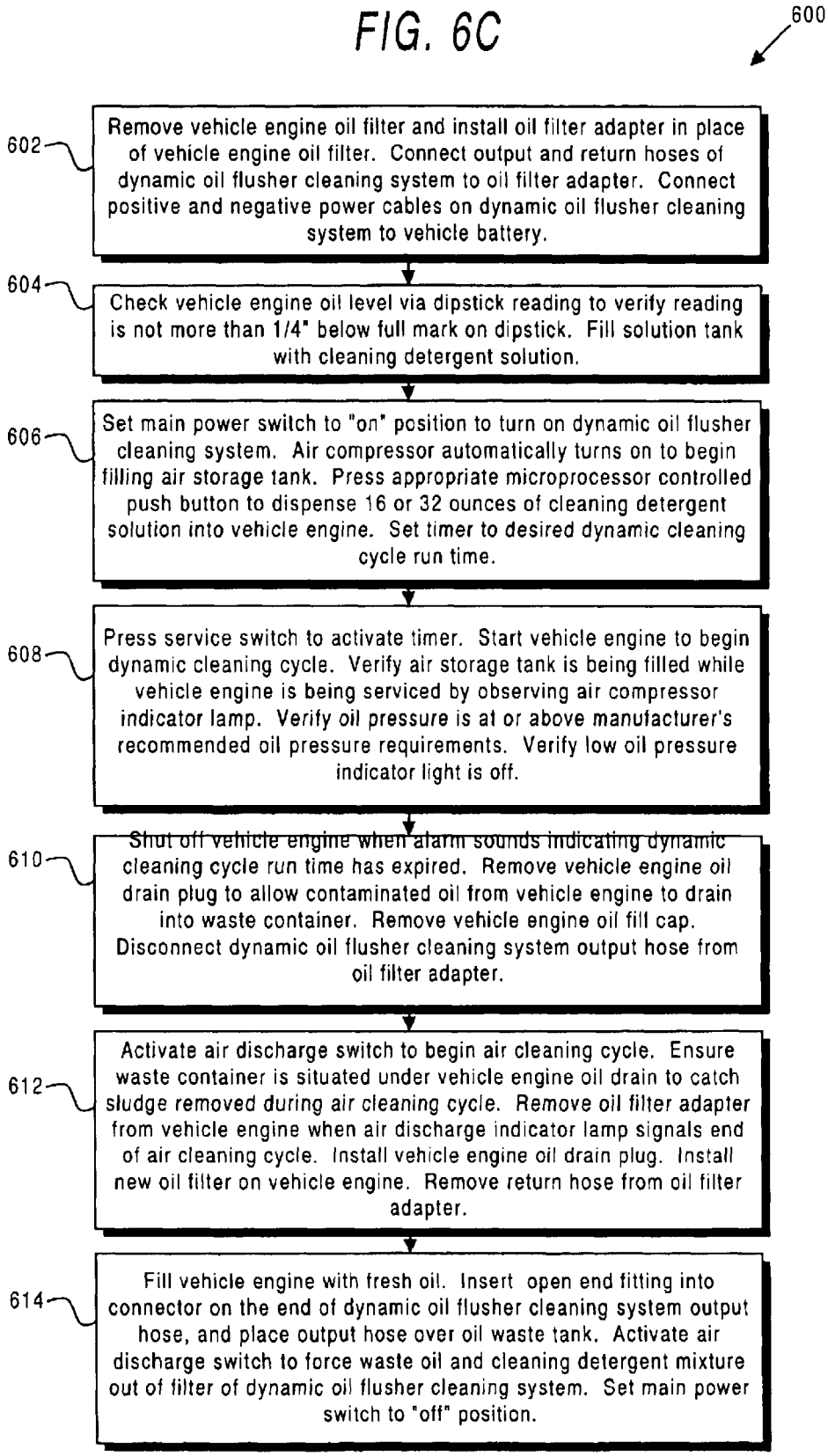
FIG. 6C illustrates an exemplary flow diagram for use in conjunction with the dynamic oil flusher cleaning system of FIG. 6A.

Turning to FIG. 6C, flowchart 600 shows example steps for cleaning a vehicle engine oil lubrication system using dynamic oil flusher cleaning system 600. Steps 602, 604, and 610 respectively correspond to steps 402, 404, and 410 in FIG. 4. In step 606, main power switch 202 in FIG. 2A can be set to the "on" position to turn on dynamic oil flusher cleaning system 600. Air compressor 664 will automatically turn on to begin filling air storage tank 656. Next, 16.0 ounce fill switch 558 or 32.0 ounce fill switch 562, respectively, on microprocessor controller PCB 557 may be pressed to dispense 16.0 ounces or 32.0 ounces of cleaning detergent solution into the vehicle engine. For example, when 16.0 ounce fill switch 558 or 32.0 ounce fill switch 562, respectively, is pressed, pump 606 begins pumping 16.0 ounces or 32.0 ounces of cleaning detergent solution from solution tank 604 into conduit 613, which is coupled to flow sensor 610. The rate of cleaning detergent solution flowing through flow sensor 610 is monitored by microprocessor 570. When microprocessor 570 determines that the appropriate amount of cleaning detergent solution has flowed through flow sensor 610 microprocessor 570 prevents more cleaning detergent solution from entering conduit 618 by stopping pump 606 and closing shut-off solenoid 612.

In step 608, service switch 568 can be pressed to activate the timer, and the vehicle engine can be started to begin the dynamic cleaning cycle. When the vehicle engine is started, the oil pump in the vehicle engine pumps a mixture of contaminated oil and cleaning detergent solution out of the vehicle engine via return hose 624. The contaminated oil and cleaning detergent mixture is then pumped by the vehicle engine oil pump into filter 653 via valve 652, conduit 651, manifold 626, conduit 640, valve 634, conduit 646, tee fitting 649 and conduit 654. Filter 653 filters the contaminated oil and cleaning detergent mixture, which is then pumped back into the vehicle engine via conduit 623, valve 621, and output hose 622. The oil and cleaning detergent mixture continues to circulate through dynamic oil flusher cleaning system 600 as described above for the duration of the dynamic cleaning cycle.

Detergent auto fill switch 205 can be turned into the "diesel fill" position or the "gasoline fill" position, respectively, to dispense 32.0 or 16.0 ounces of cleaning detergent solution into the vehicle engine for servicing a diesel or gasoline vehicle engine. In the vehicle engine, the cleaning detergent solution mixes with contaminated oil in the vehicle engine oil lubrication system. In one embodiment, display 566 can indicate the appropriate amount of cleaning detergent solution, i.e. 16.0 or 32.0 ounces, being dispensed into the vehicle engine.

Air compressor indicator lamp 574 may be observed to determine whether air compressor 564 is filling air storage tank 656. For example, air compressor indicator lamp 574 is illuminated when air compressor 564 is filling air storage tank 656. Oil pressure gauge 206 can be read to verify vehicle engine oil pressure is at or above manufacturer's recommended oil pressure requirements. Adequate vehicle engine oil pressure can also be verified by observing that low oil pressure indicator lamp 508 is not lit.

Step 612 is similar to step 412 in FIG. 4. However, in step 612, main power switch 502 remains in the "on" position. In step 614, waste oil and cleaning detergent mixture may be automatically removed from filter 653 by the procedure discussed below in FIG. 10. The procedure discussed below in FIG. 10 may also be used to automatically remove waste oil and cleaning detergent mixture from solution housing 112 in dynamic oil flusher cleaning system 100 in FIG. 1. After waste oil and cleaning detergent mixture has been removed from filter 653, main power switch 502 can be set to the "off" position.

Figure 7B:
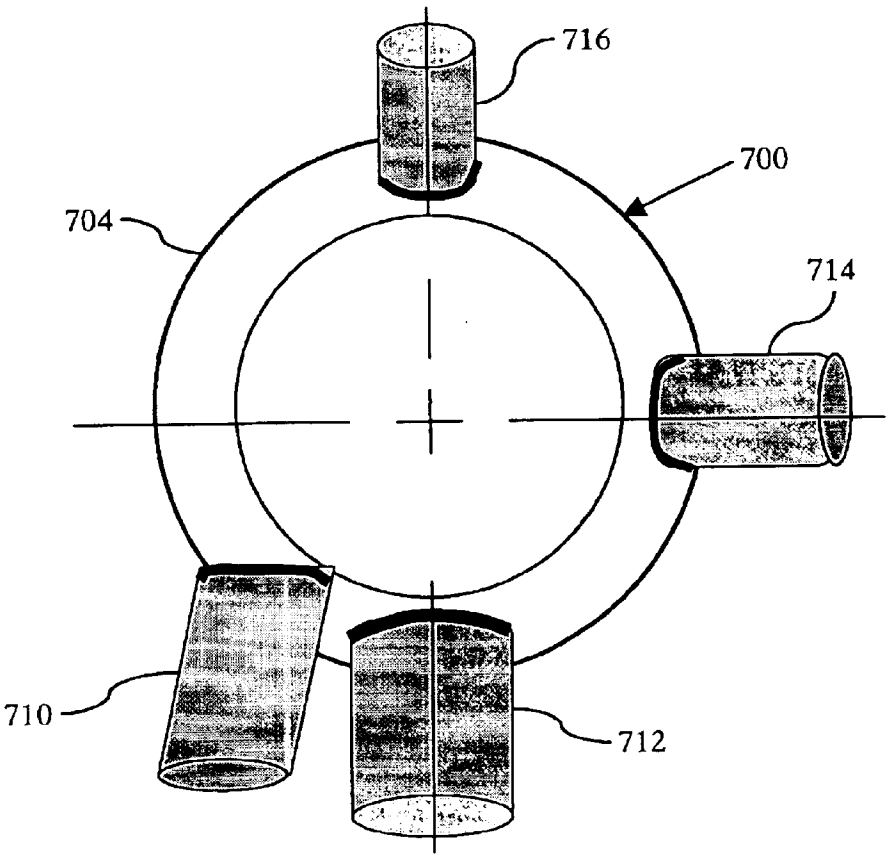
FIG. 7B illustrates an exemplary top view of a thread gauge for use in conjunction with the dynamic oil flusher cleaning system of FIG. 1 or 6A.
Figure 7A:
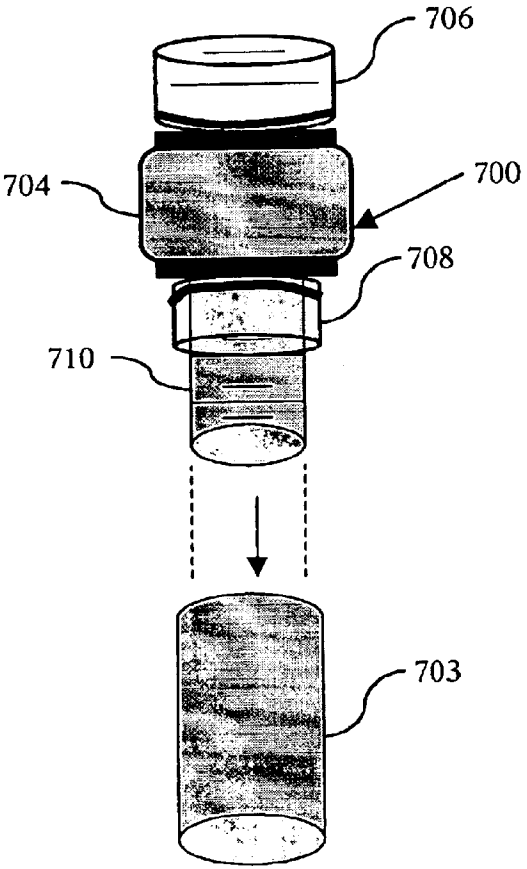
FIG. 7A illustrates an exemplary side view of a thread gauge for use in conjunction with the dynamic oil flusher cleaning system of FIG. 1 or 6A.

FIGS. 7A and 7B show a thread gauge according to one embodiment of the present invention. FIG. 7A shows thread gauge 700 from the side and FIG. 7B shows thread gauge 700 from the top for greater clarity. Thread gauge 700 can be utilized to determine the correct threaded adapter insert required to connect dynamic oil flusher cleaning system 600 to vehicle engine 602. For example, thread gauge 700 can be fit checked into the inner diameter thread of a vehicle engine oil filter, such as vehicle engine oil filter 703, to determine the thread size of the vehicle engine oil filter. The correct thread size of the vehicle engine oil filter can then be matched to the correct threaded adapter insert required to connect dynamic oil flusher cleaning system 600 to vehicle engine 602.

As shown in FIG. 7A, thread gauge 700 includes thread gauge barrel 704, threaded oil filter adapter inserts 706 and 708, and threaded stud 710. Thread gauge barrel 704 provides a structure for mounting threaded studs, such as threaded stud 710, and storing adapter inserts, such as adapter inserts 706 and 708. Thread gauge barrel 704 may have a circular barrel shape. In one embodiment, the applicable thread size of threaded studs, such as threaded stud 710, may be engraved or etched on the outer surface of thread gauge barrel 704. Thread gauge barrel 704 can include one or more different threaded studs, such as threaded stud 710, mounted on the outer surface of thread gauge barrel 704. In one embodiment, thread gauge barrel 804 may include seven different threaded studs, such as threaded stud 710, mounted on the outer surface of thread gauge barrel 704.

Threaded stud 710 may be attached to threaded gauge barrel 704 by press fitting threaded stud 710 into a hole formed in threaded gauge barrel 704. In one embodiment, threaded stud 710 may be attached to threaded gauge barrel 704 by screwing threaded stud 710 into a threaded hole formed in threaded gauge barrel 704. In another embodiment, threaded stud 710 may be attached to threaded gauge barrel 704 by welding threaded stud 710 to threaded gauge barrel 704. Threaded stud 710 can be threaded for standard metric or SAE (Society of Automotive Engineers)

thread sizes. For example, threaded stud 710 may have a metric thread size such as 18.0×1.5 millimeter (mm), 20.0×1.5 mm, or 22×1.5 mm. Further, threaded stud 710 may have an SAE thread size such as ¾"–16, 13/16"–16, or 1½–16. Threaded stud 710 can be color-coded to match an applicable adapter insert, such as threaded adapter insert 706 or threaded adapter insert 708.

Threaded adapter inserts 706 and 708 can be mounted and stored on threaded gauge barrel 704 for easy access. Threaded adapter inserts 706 and 708 are utilized to appropriately couple dynamic oil flusher cleaning system 100 or 600 to a vehicle engine. Threaded adapter inserts 706 and 708 can be color-coded to match the appropriately color-coded threaded stud, such as threaded stud 710.

As shown in FIG. 7B, thread gauge 700 includes threaded gauge barrel 704, and threaded studs 710, 712, 714, and 716. However, threaded adapter inserts 706 and 708 are not shown in FIG. 7B to preserve simplicity. Further, threaded studs 712, 714, and 716 are similar to threaded stud 710 discussed above.

Thread gauge 700 allows an operator to quickly determine the appropriate threaded adapter insert to connect oil filter adapter 120 to a vehicle engine to be serviced. Furthermore, the color-coded threaded studs and threaded adapter inserts discussed above eliminate costly operator errors, such as cross-threading the wrong size threaded adapter insert into a vehicle engine oil filter housing.

Figure 8:
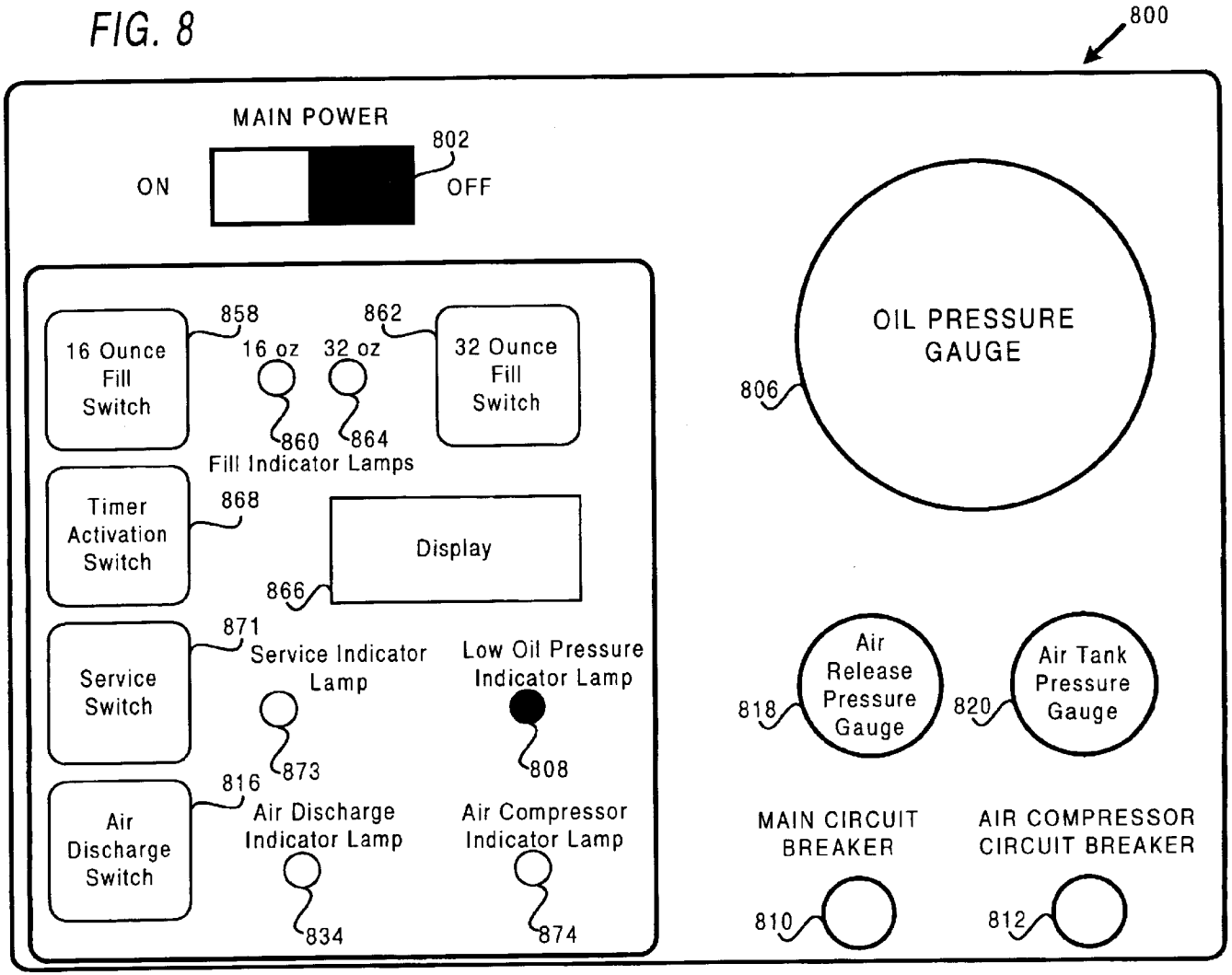
FIG. 8 illustrates an exemplary control panel for use in conjunction with the dynamic oil flusher cleaning system of FIG. 1 or 6A.

FIG. 8 shows an exemplary control panel 800 in accordance with one embodiment of the present invention. Control panel 800 includes main power switch 802, oil pressure gauge 806, main circuit breaker 810, air compressor circuit breaker 812, and air release pressure gauge 818, which respectively correspond to main power switch 202, oil pressure gauge 206, main circuit breaker 210, air compressor circuit breaker 212, and air release pressure gauge 218 in FIG. 2A.

Control panel 800 also includes low oil pressure indicator lamp 808, air discharge switch 816, air discharge indicator lamp 834, 16.0 ounce fill switch 858, 16.0 ounce fill indicator lamp 860, 32.0 ounce fill switch 862, 32.0 ounce fill indicator lamp 864, display 866, timer activation switch 868, service switch 871, service indicator lamp 873 and air compressor indicator lamp 874, which respectively correspond to low oil pressure indicator lamp 508, air discharge switch 516, air discharge indicator lamp 534, 16.0 ounce fill switch 558, 16.0 ounce fill indicator lamp 560, 32.0 ounce fill switch 562, 32.0 ounce fill indicator lamp 564, display 566, timer activation switch 568, service switch 571, service indicator lamp 573, and air compressor indicator lamp 574 in FIG. 5.

Control panel 800 further includes air tank pressure gauge 820 for measuring the air pressure of an air storage tank, such as air storage tank 656 in FIG. 6A. In one embodiment, air tank pressure gauge 820 can have a range of 0.0 psig to 160.0 psig. Control panel 800 also includes a microprocessor (not shown in FIG. 8), such as microprocessor 570 in FIG. 5, for controlling the operation of control panel 800. In one embodiment, the nicroprocessor in control panel 800 may control dynamic oil flusher cleaning system 100 in FIG. 1. In another embodiment, the microprocessor in control panel 800 may control dynamic oil flusher cleaning system 600 in FIG. 6A.

Figure 9:
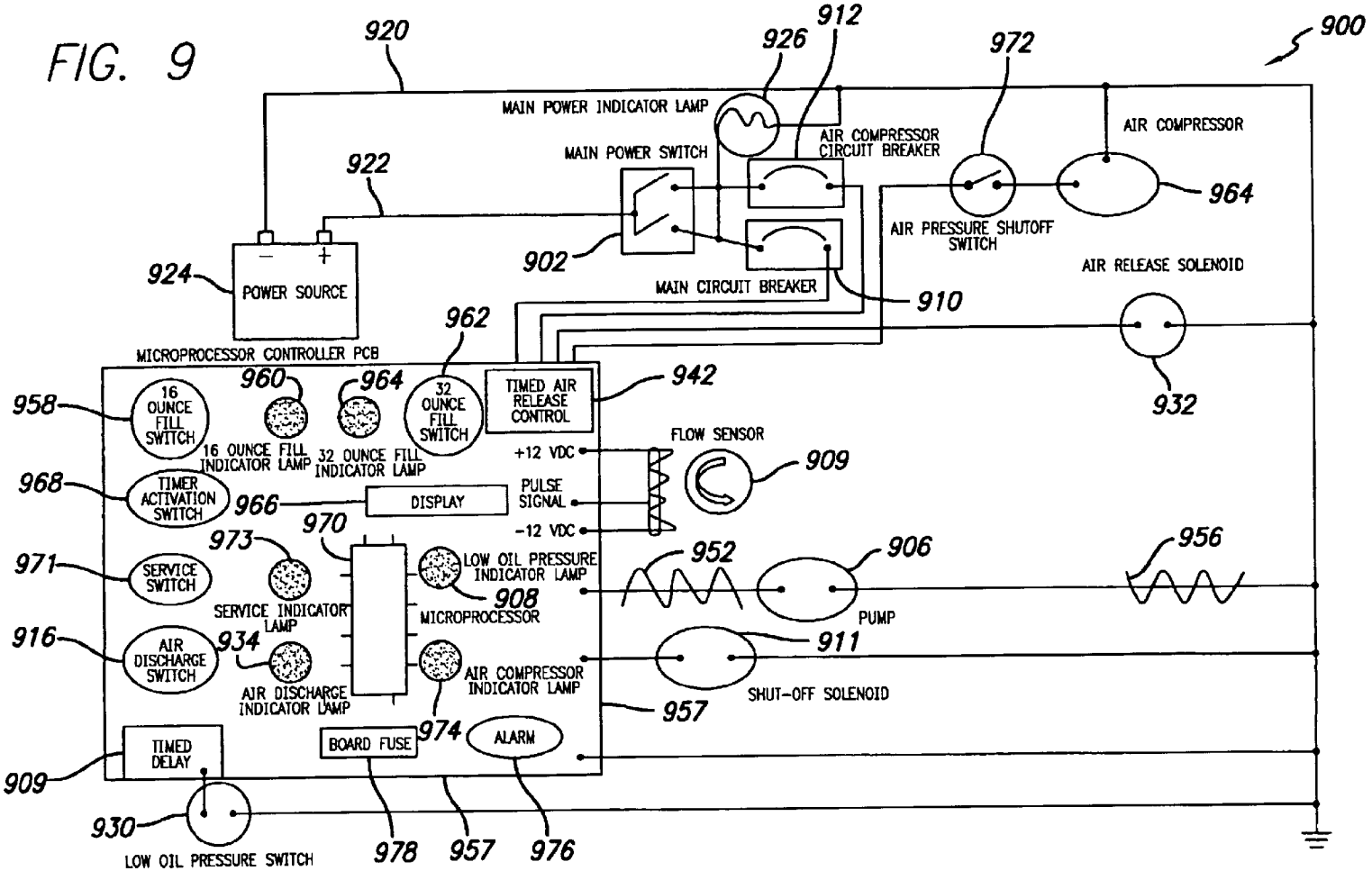
FIG. 9 illustrates an exemplary electrical schematic of the dynamic oil flusher cleaning system of FIG. 6A.

Turning now to FIG. 9, electrical schematic 900 is shown for one embodiment of the present invention. Electrical schematic 900 includes power source 924, negative power cable 920, positive power cable 922, main power switch 902, main power indicator lamp 926, air compressor circuit breaker 912, main circuit breaker 910, air pressure shutoff switch 972, air compressor 564, air release solenoid 932, pump 906, inductor filter coils 952 and 956, and low oil pressure switch 930, which respectively correspond to power source 524, negative power cable 520, positive power cable 522, main power switch 502, main power indicator lamp 526, air compressor circuit breaker 512, main circuit breaker 510, air pressure shutoff switch 572, air compressor 564, air release solenoid 532, pump 506, inductor filter coils 552 and 556, and low oil pressure switch 530.

Electrical schematic 900 further includes low oil pressure indicator lamp 908, air discharge switch 916, air discharge indicator lamp 934, 16.0 ounce fill switch 958, 16.0 ounce fill indicator lamp 960, 32.0 ounce fill switch 962, 32.0 ounce fill indicator lamp 964, display 966, timer activation switch 968, service switch 971, service indicator lamp 973, air compressor indicator lamp 974, microprocessor 970, timed delay 909, board fuse 978, and alarm 976, which respectively correspond to low oil pressure indicator lamp 508, air discharge switch 516, air discharge indicator lamp 534, 16.0 ounce fill switch 558, 16.0 ounce fill indicator lamp 560, 32.0 ounce fill switch 562, 32.0 ounce fill indicator lamp 564, display 566, timer activation switch 568, service switch 571, service indicator lamp 573, air compressor indicator lamp 574, microprocessor 570, timed delay 509, board fuse 578 in FIG. 5.

Electrical schematic 900 also includes flow sensor 909 and shut-off solenoid 911, which respectively correspond to flow sensor 610 and shut-off solenoid 612 in FIG. 6A. As shown in electrical schematic 900, flow sensor 909 and shut-off solenoid 911 are in communication with microprocessor controller PCB 957. In one embodiment, shut-off solenoid 911 may be activated, i.e. opened, by a pulse signal received from flow sensor 909. Flow sensor 909 can send a pulse signal to activate shut-off solenoid 911 when cleaning detergent solution is dispensed by pump 906 into a vehicle engine, such as vehicle engine 602 in FIG. 6A. In one embodiment, shut-off solenoid 911 may be replaced by a mechanical 0.5 psig one-way flow check valve.

Similar to microprocessor 570 described above, microprocessor 970 may include software for performing maintenance functions in dynamic oil flusher cleaning system 600. In one embodiment, microprocessor 970 may include software to enable air condensation to be purged in air compressor 964 by activating air release solenoid 932 when output hose 622 and return hose 624 in FIG. 6A are vented to atmosphere. In one embodiment, microprocessor 970 may include similar software for testing electrical and electromechanical circuits of dynamic oil flusher cleaning system 600 as described above in reference to microprocessor 570 in FIG. 5.

Figure 10:
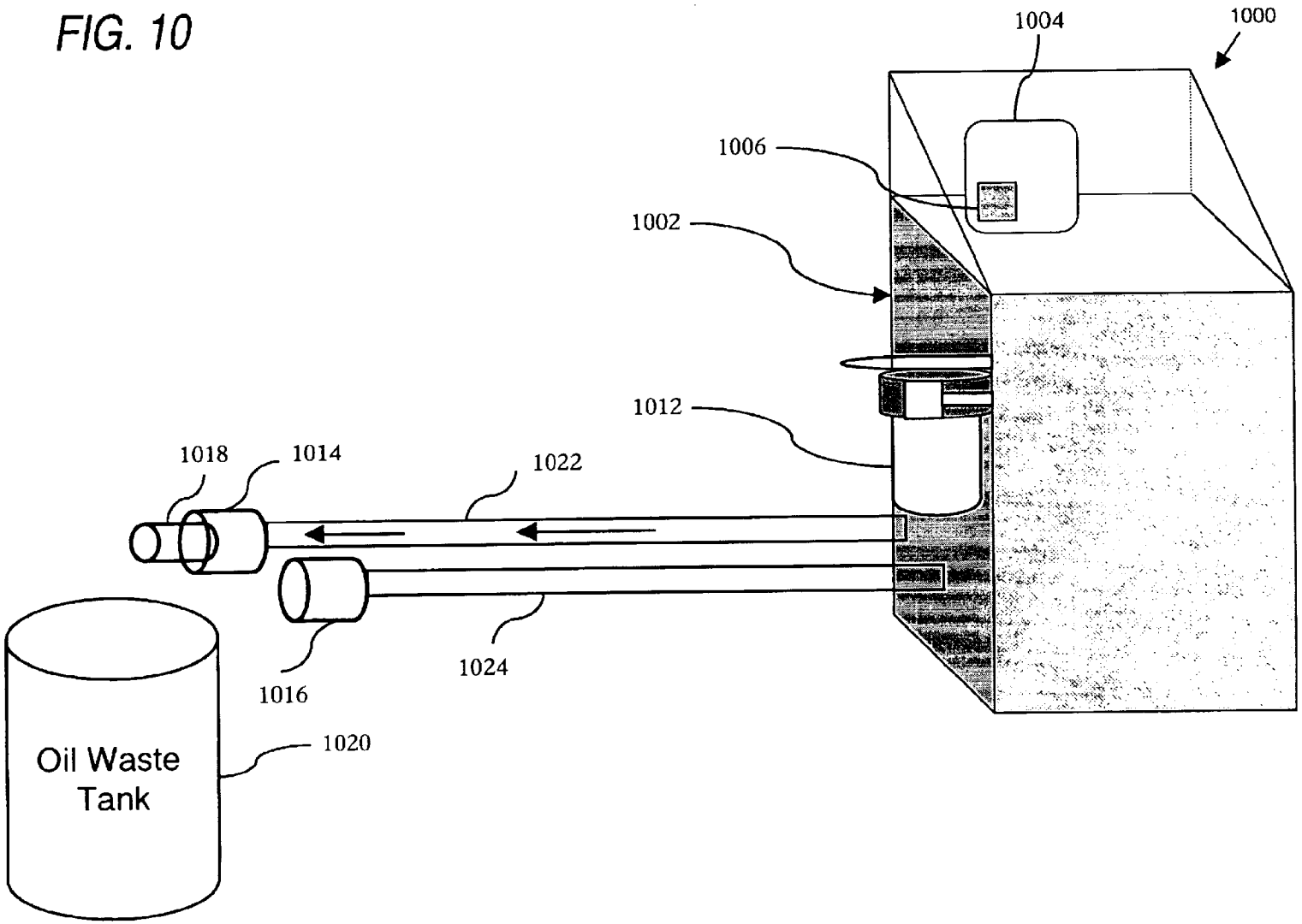
FIG. 10 illustrates an exemplary diagram of a draining system of the dynamic oil flusher cleaning system of FIG. 1 or 6A.

Diagram 1000 in FIG. 10 shows dynamic oil flusher cleaning system 1002 coupled to control panel 1004. Dynamic oil flusher cleaning system 1002 may generally correspond to dynamic oil flusher cleaning system 600 in FIG. 6A. Dynamic oil flusher cleaning system 1002 includes output hose 1022 and return hose 1024 which respectively correspond to output hose 622 and return hose 624 in FIG. 6A.

Dynamic oil flusher cleaning system 1002 also includes check valve connectors 1014 and 1016, which are connected to output hose 1022 and return hose 1024, respectively. Connectors 1014 and 1016 respectively correspond to connectors coupled to output hose 622 and return hose 624 in FIG. 6. Diagram 1000 includes open end fitting 1018, which may be inserted into connector 1014 to open a check valve in connector 1014 to allow fluid to flow out of output hose 1022. Dynamic oil flusher cleaning system 1000 also includes oil waste tank 1020 for receiving waste oil and cleaning detergent mixture.

Dynamic oil flusher cleaning system 1000 further includes control panel 1004, which corresponds to control panel 800 in FIG. 8. Control panel 1004 can control the operation of dynamic oil flusher cleaning system 1002. Control panel 1004 includes air discharge switch 1006, which corresponds to air discharge switch 816 in FIG. 8.

At completion of servicing a vehicle engine oil lubrication system, waste oil and cleaning detergent mixture may be purged from filter 1012 and deposited into oil waste tank 1020. For example, at completion of servicing a vehicle engine oil lubrication system, output hose 1022 and return hose 1024 may be disconnected from the vehicle engine. Open end fitting 1018 can be inserted into connector 1018 to allow waste oil and cleaning detergent mixture to flow out of output hose 1022. Air discharge switch 1006 may be pressed to activate an air release solenoid, such as air release solenoid 632 in FIG. 6, to allow pressurize-regulated air to force waste oil and cleaning detergent mixture out of filter 1012. The waste oil and cleaning detergent mixture can discharge into oil waste tank 1020 via output hose 1022 and open end fitting 1018.

A novel method and system for servicing a vehicle engine oil lubrication system has been hereby presented. The present invention may be embodied in other specific forms without departing from its spirit or essential characteristics. The described embodiments are to be considered in all respects only as illustrative and not restrictive. For example, various inventive features of the present invention may be implemented in a static system, although the present invention is described in conjunction with a dynamic system. Those skilled in the art will recognize that changes and modifications may be made to the embodiments without departing from the scope of the present invention. These and other changes or modifications are intended to be included within the scope of present invention, as broadly described herein.

What is claimed is:

1. A cleaning apparatus for cleaning a system having a first fluid, said cleaning apparatus comprising:

a second fluid;

an air compressor; and an air storage tank;

wherein said air compressor compresses air into said air storage tank, wherein said second fluid enters said system and cycles in said system with said first fluid for a predetermined period of time, and wherein after said predetermined period of time, said air in said air storage tank is delivered to said system for purging said first fluid and said second fluid from said system.

2. The cleaning apparatus of claim 1, wherein said system includes a system outlet, said cleaning apparatus further comprising an air conduit coupled to said system outlet to deliver said air to said system.

3. The cleaning apparatus of claim 1, wherein said system includes a system inlet, said cleaning apparatus further comprising an air conduit coupled to said system inlet to deliver said air to said system.

4. The cleaning apparatus of claim 1 further comprising an air regulator for regulating a pressure of said air being delivered to said system.

5. The cleaning apparatus of claim 1 further comprising an air pressure shutoff switch for shutting off said air compressor when an air pressure reaches a predetermined level.

6. The cleaning apparatus of claim 5 further comprising an air pressure gauge coupled to said air compressor for measuring said air pressure.

7. The cleaning apparatus of claim 1 further comprising a timed air release control controlling an air release solenoid, wherein said air release solenoid receives said air from said air storage tank and delivers said air to said system.

8. A method of cleaning a system having a first fluid, said method comprising the steps of:

providing a second fluid into said system;

cycling said first fluid and said second fluid in said system;

compressing air into an air storage tank;

terminating said cycling step;

terminating said compressing step; and purging said first fluid and said second fluid from said system using said air in said air storage tank.

9. The method of claim 8, wherein said providing and said cycling steps substantially overlap with said compressing step.

10. The method of claim 8, wherein said compressing step is performed prior to said providing step.

11. The method of claim 8, wherein said step of purging includes regulating a pressure of said air.

12. The method of claim 8, wherein said step of terminating said compressing step includes measuring an air pressure and ending said compressing step when said air pressure reaches a predetermined level.

13. The method of claim 8, wherein said system includes a system pump and said system pump performs said cycling step.

* * * * *